US008511246B2

(12) United States Patent
Srinivasan

(10) Patent No.: US 8,511,246 B2
(45) Date of Patent: Aug. 20, 2013

(54) OFFSHORE FLOATING PRODUCTION, STORAGE, AND OFF-LOADING VESSEL FOR USE IN ICE-COVERED AND CLEAR WATER APPLICATIONS

(76) Inventor: Nagan Srinivasan, Missouri City, TX (US)

( * ) Notice: Subject to any disclaimer, the term of this patent is extended or adjusted under 35 U.S.C. 154(b) by 0 days.

(21) Appl. No.: 13/159,383

(22) Filed: Jun. 13, 2011

(65) Prior Publication Data

US 2012/0298027 A1 Nov. 29, 2012

Related U.S. Application Data

(62) Division of application No. 12/006,486, filed on Feb. 2, 2008, now Pat. No. 7,958,835.

(60) Provisional application No. 60/878,272, filed on Jan. 1, 2007.

(51) Int. Cl.

| | |
|---|---|
| ***B63B 35/44*** | (2006.01) |
| ***B63B 21/50*** | (2006.01) |
| ***B63B 22/02*** | (2006.01) |
| ***B63B 39/03*** | (2006.01) |
| ***B63B 39/06*** | (2006.01) |

(52) U.S. Cl.

USPC ..... 114/264; 114/125; 114/126; 114/230.12; 114/230.13; 441/3; 405/195.1; 405/217

(58) Field of Classification Search

USPC ..... 114/40–42, 65 R, 121, 125, 126, 114/230.1, 230.12, 230.13, 264, 265; 441/3–5; 405/195.1–209, 211, 217

See application file for complete search history.

(56) References Cited

U.S. PATENT DOCUMENTS

| | | | | |
|---|---|---|---|---|
| 4,048,943 | A * | 9/1977 | Gerwick, Jr. | 114/256 |
| 4,434,741 | A * | 3/1984 | Wright et al. | 114/264 |
| 4,639,167 | A * | 1/1987 | Petty et al. | 405/217 |
| 4,808,036 | A * | 2/1989 | Bhalaik et al. | 405/217 |
| 7,086,810 | B2 * | 8/2006 | Masetti et al. | 405/224 |
| 7,958,835 | B2 * | 6/2011 | Srinivasan | 114/264 |

* cited by examiner

*Primary Examiner* — Ajay Vasudeva
(74) *Attorney, Agent, or Firm* — Kenneth A. Roddy

(57) ABSTRACT

An offshore floating production, storage, and off-loading vessel has a hull of generally cylindrical or polygonal configuration surrounding a central double tapered conical moon pool and contains water ballast and oil and/or liquefied gas storage compartments. An adjustable water ballast system induces heave, roll, pitch and surge motions of the vessel to dynamically position and maneuver the vessel. The moon pool shape and other devices on the vessel provide added virtual mass for increasing the natural period of the roll and heave modes, reducing dynamic amplification and resonance due to waves and vessel motion, and facilitate maneuvering the vessel. A disconnectable turret buoy at the bottom of the moon pool connects risers and mooring lines.

17 Claims, 17 Drawing Sheets

100% turret mooring

100% vessel mooring

Dual Mooring - 50% vessel mooring – 50% turret mooring

OFFSHORE FLOATING PRODUCTION, STORAGE, AND OFF-LOADING VESSEL FOR USE IN ICE-COVERED AND CLEAR WATER APPLICATIONS

CROSS REFERENCE TO RELATED APPLICATION

This application is a divisional of and claims priority of U.S. patent application Ser. No. 12/006,486, filed Jan. 2, 2008 now U.S. Pat. No. 7,958,835, which claimed priority of U.S. Provisional Application Ser. No. 60/878,272, filed Jan. 1, 2007, the pendency of which was extended until Jan. 2, 2008 under 35 U.S.C. 119(e)(3).

BACKGROUND OF THE INVENTION

1. Field of the Invention

This invention relates generally to offshore floating vessels and offshore clear water vessels used for exploration and production of offshore oil and gas, and more particularly to an offshore floating production, storage, and off-loading vessel having a non ship-shaped hull of generally cylindrical or polygonal configuration surrounding a central double tapered conical moon pool that provides added virtual mass, increases the natural period of roll and heave modes, and reduces dynamic amplification and resonance, and contains ballast and storage compartments.

2. Background Art

The development of oil and gas fields in seas of ice-covered water, such as the Piltun-Astokhskoye field located offshore of Sakhalin Island, Russia, in the Sea of Okhotsk, present enormous design load challenges for engineers of semi-submersible vessels, and floating production, storage and off-loading (FPSO) vessels. The Sea of Okhotsk is subject to dangerous storm winds, severe waves, icing of vessels, intense snowfalls and poor visibility. The top surface of the sea is covered with ice sheets ranging in thickness of from about 1 m to 2 m and moving at speeds of 1-2 knots. Broken rubbles of ice (one year or multiyear) can build up to 25 m deep. This ice covered water environment typically lasts anywhere from 150 to 230 days, and during the ice-free period or "clear water field" days wave heights range between 1-3 m, but can reach as high as 19 m during 100-year storm conditions. These areas are also subject to frequent severe seismic activity. The water depth ranges from 40 m to 300 m.

A few arctic mobile offshore drilling units have been constructed to operate primarily in water depths from about 12 m-50 m. Sakhalin Energy Investment Company has modified and refurbished an Arctic Class Drilling Vessel, known as the Molikpaq, a single anchor leg (bottom founded steel caisson) which is an ice-resistant structure, originally built to explore for oil in the Canadian Beaufort Sea. This vessel is mobile but a bottom founded steel caisson structure with hollow central core filled with sand to provide resistance to the environmental loadings. The Molikpaq has no storage options and has been modified by adding a steel pontoon base and is installed bottom fixed in 30 m water at Piltun-Astokhskoye Field, 16 km offshore of Sakhalin Island's Northeast shore in the sea of Okhotsk. An independent Floating Storage and Offloading facility (FSO) is used in conjunction with this bottom mounted gravity fixed production platform.

Other types of platforms that are used in ice-covered waters include gravel or ice islands, fixed platforms and conventional floating platforms. Gravel or ice islands are limited to water depths up to 10 m.

Jacket type fixed platforms are incapable of withstanding the large lateral forces generated by large ice fields and ice floes. In general, water depths over 60 m could be declared deep in the Arctic zone and floating vessels are inevitable in the design. Single and multiyear pressure ridges, like 20 m-30 m drafts are strong enough to destroy the fixed arctic platforms.

There are several patents directed toward arctic platforms and vessels.

Bennett, U.S. Pat. No. 3,696,624 discloses counter-rotating bucket wheels mounted on offshore platforms or ship prows for cutting ice sheets found in frigid waters. The bucket wheels rotate in a generally horizontal plane and are paired in opposite directions so that a torque is not placed on the structure or ship. Multiple sets of bucket wheels can be used to cut a thick section of ice and/or the bucket wheels can be inclined or arranged to oscillate up and down to cut a larger vertical section. This apparatus provides an extensive and expensive mechanically powered way of managing ice for the large season of ice-covered water period in the arctic zone.

Stone, U.S. Pat. No. 3,807,179 discloses a hydraulically operated deicing system of apparatus for protecting columns of offshore structures from dynamic forces of ice in which a plurality of upwardly movable ice-lifting elements are supported around the column and means are provided for moving the elements upwardly against the ice to break large blocks of ice from the icepack. The ice-breaking elements may be combined with inclined planes adapted to exert upward forces on the ice.

Ehrlich, U.S. Pat. No. 4,103,504 discloses a semi-rigid interface between a moving ice field and a stationary offshore platform employing a plurality of cables which extend from points located around the periphery of the platform above the ice-covered water to corresponding points on the submerged portion of the structure, forming a protective shield of evenly spaced cables around the structure. The cables may then be caused to vibrate at predetermined frequencies, thereby reducing the frictional forces of the ice against the structure and additionally including a self-destructive natural frequency in the surrounding ice field. A compressible bladder or filler is used between the cables and the structure to prevent ice buildup behind the cables. This method of ice resistance is inefficient and requires maintenances of the cables. Moreover, ice forces typically are not uniform all around and are primarily in the direction of the ice flow movements. Thus, a uniform lifting of the hull due to the ice contact load to the hull is not possible. Hence, the mooring tension on the cables is different among the mooring lines. Additionally, a massive structure is required to resist large ice.

Gerwick, Jr. et al, U.S. Pat. No. 4,433,941 discloses a floating hull structure having ice-breaking capabilities which is moored by a plurality of flexible mooring lines that extend vertically from a moonpool in the hull to the marine bottom directly under the hull. The mooring lines are tensioned by tensioning means within the moonpool to draw the hull downward to a position below its normal buoyant position thereby substantially eliminating vertical heaving of the hull. When an ice mass contacts the hull, tension on the mooring lines is relaxed to allow the hull to rock upward against the ice thereby generating the forces necessary for the ice-breaking operation.

Oshima et al, U.S. Pat. No. 4,457,250 discloses a floating-type offshore structure having a main body with a lower hull and plurality of struts supporting a platform above the sea level and which is moored through mooring lines at an offshore location. The structure is adapted for use under both of an ice-covered and an iceless conditions of the sea by adjusting the amount of ballast water contained in a ballast tank or tanks formed in the lower hull and/or the struts and adapted for causing ice floes to undergo downward flexural failure on account of bending stresses when they move into the sea water along the ice contacting face of the strut which is inclined inwardly and downwardly. The contact area of the struts is limited and, thus, the efficient of the ice breaking is limited. There is also no large storage facility feasible with this structure.

There are several patents directed toward ship-shaped and vertical cylinder shaped moored floating vessels that are used for offshore oil and Liquid Natural Gas (LNG) storage in clear water applications.

Daniell, U.S. Pat. No. 4,606,673 discloses a stabilized spar buoy for deep sea operations including an elongated submerged hull having a selected volume and a selected water plane area, mooring lines connecting the bottom portions of the hull with the sea bottom. The hull has oil storage chambers and variable ballast chambers to establish and maintain a constant center of gravity of the spar buoy at a selected distance below the center of buoyancy. A riser system extends through a through passageway in the hull, and a riser float chamber having pitch oscillations of the same amplitude as the hull maintains tension on the riser system and minimizes pitch motions therein. The bending stresses in the riser system between the sea floor and the riser float chamber are minimized by maintaining a selected constant distance between the center of gravity and the center of buoyancy under different load conditions of the spar buoy. The variable ballast chambers in the hull extend above the oil storage chambers.

Smedal et al, U.S. Pat. No. 6,945,736 discloses a semi-submersible platform for drilling or production of hydrocarbons at sea, consisting of a semi-submersible platform body that supports drilling and/or production equipment on its upper surface. The platform body is designed as a vertical mainly flat bottomed cylinder which is provided with at least one peripheral circular cut-out in the lower section of the cylinder since the center of buoyancy for the submerged section of the platform is positioned lower than the center of gravity of the platform. This structure is similar to the spar structure of Daniell, U.S. Pat. No. 4,606,673, except there are no moving parts inside, and the diameter is larger than the draft, and the center of gravity is below the center of buoyancy. The circular cut-out which is relied upon to minimize the roll and pitch of the semi-submersible is relatively small compared to the diameter/draft dimension of the vessel, and the edges above and below the cut-out will create whirls in the water which runs therethrough. Thus, the efficiency of the small cut-out in dampening the roll and pitch motion and its strength in controlling the large vertical floating cylinder is reduced.

Haun, U.S. Pat. No. 6,761,508 discloses a floating Satellite separator platform (SSP) for offshore deepwater developments having motion characteristics with vertical axial symmetry and decoupling of hydrodynamic design features. A motion-damping skirt is provided around the base of the hull, which is configured to provide ease of installation for various umbilicals and risers. A retractable center assembly is used in a lowered position to adjust the center of gravity and metacentric height, reducing wind loads and moments on the structure, providing lateral areas for damping and volume for added mass for roll resistance. The center assembly is used to tune system response in conjunction with the hull damping skirt and fins. The center assembly also includes separators below the floating platform deck capable of being raised and lowered alone or as a unit serve to add stability to the floating structure by shifting the center of gravity downward.

The ship-shaped and vertical cylinder shaped moored floating vessels discussed above that are used for offshore oil and liquid natural gas (LNG) storage in clear water applications, including the spar-type structures, do not incorporate an ice-breaking or ice management system in the vessel design, nor any ice resistant shape to the outer structure. Thus, these types of vessels and platforms are not arctic class structures and are not particularly suited to withstand ice covered waters near the arctic zone.

The present invention is distinguished over the prior art in general, and these patents in particular by an offshore floating production, storage, and off-loading vessel having a monolithic non ship-shaped hull of generally cylindrical or polygonal configuration surrounding a central double tapered conical moon pool and contains water ballast and oil and/or liquefied gas storage compartments. The exterior side walls of the polygonal hull have flat surfaces and sharp corners to cut ice sheets, resist and break ice, and move ice pressure ridges away from the structure. An adjustable water ballast system induces heave, roll, pitch and surge motions of the vessel to dynamically position and maneuver the vessel to accomplish ice cutting, breaking and moving operations. The moon pool configuration provides added virtual mass capable of increasing the natural period of the roll and heave modes, reduces dynamic amplification and resonance due to waves and vessel motion, and facilitates maneuvering the vessel. The vessel may be moored by a disconnectable buoyant turret buoy which is received in a support frame at the bottom of the moon pool and to which flexible well risers and mooring lines are connected.

SUMMARY OF THE INVENTION

It is therefore an object of the present invention to provide an offshore floating production, storage, and off-loading vessel for exploration and production of oil and gas that will effectively resist, break and manage floating and stationary ice sheets and pressure ridges.

It is another object of this invention to provide a massive offshore floating production, storage, and off-loading vessel for exploration and production of oil and gas that has large inertial strength to resist ice sheets and which is capable of moving and managing ice ridges.

Another object of this invention is to provide a massive offshore floating production, storage, and off-loading vessel wherein the vessel size is maximized to the feasible size and capacity of fabrication, transportation, installation and maintenance, and is capable of being moored either by a catenary line anchor system or dynamically positioned in ice-covered water.

Another object of this invention is to provide an offshore floating production, storage, and off-loading vessel wherein the weight and operational utility of the hull is increased by accommodating oil and/or liquefied gas storage, fixed and variable ballast storage, drilling and production equipment, ballast and oil and/or liquefied gas pump system equipment, and offloading system equipment Another object of this invention is to provide an offshore floating production, storage, and off-loading vessel which incorporates a mooring system and/or dynamic positioning system with an adjustable water ballast system to induce heave, roll, pitch and surge motion of the vessel and thereby dynamically break, bend and push the ice sheets by flexural failure of the ice.

Another object of this invention is to provide an offshore floating production, storage, and off-loading vessel which incorporates a mooring system and/or dynamic positioning system with an adjustable water ballast system to induce heave, roll, pitch and surge motion of the vessel and thereby dynamically push and twist the vessel to manipulate ice pressure ridges away in the passage of the structure.

Another object of this invention is to provide an offshore floating production, storage, and off-loading vessel wherein the outer structure has a polygonal configuration with flat surfaces and sharp corners to cut ice sheets, resist and break ice, and to maneuver ice pressure ridges away from the structure.

Another object of this invention is to provide an offshore floating production, storage, and off-loading vessel having internal storage and drilling production capabilities which are not adversely affected by seismic activity.

Another object of this invention is to provide an offshore floating production, storage, and off-loading vessel having a central moon pool opening for well drilling, services and production and which protects risers extending through the moon pool.

Another object of this invention is to provide an offshore floating production, storage, and off-loading vessel having a central double tapered conical moon pool opening for providing added virtual mass capable of increasing the natural period of the roll and heave modes and reducing the heave and roll motions Another object of this invention is to provide an offshore floating production, storage, and off-loading vessel having a central double tapered conical moon pool configuration that increases the heave natural period by reducing the water plane area without appreciably affecting the moment of inertia.

Another object of this invention is to provide an offshore floating production, storage, and off-loading vessel having several devices for adding hydrodynamic virtual mass capable of increasing the natural period of the roll and heave modes, reducing dynamic amplification and resonance due to waves and vessel motion, and facilitate maneuvering the vessel.

Another object of this invention is to provide an offshore floating production, storage, and off-loading vessel having flow damping devices for dynamically stabilizing the vessel.

Another object of this invention is to provide an offshore floating production, storage, and off-loading vessel having a disconnectable turret mooring system that allows connection of flexible risers and mooring lines and provides a dual mooring means for connecting mooring lines to both the turret and the vessel.

A further object of this invention is to provide an offshore floating production, storage, and off-loading vessel having a telescoping keel tank with ballast that allows adjusting the center of gravity of the vessel to a desired design value.

A still further object of this invention is to provide an offshore floating production, storage, and off-loading vessel that is simple in construction, and easily transported.

Other objects of the invention will become apparent from time to time throughout the specification and claims as hereinafter related.

The above noted objects and other objects of the invention are accomplished by an offshore floating production, storage, and off-loading vessel having a monolithic non ship-shaped hull of generally cylindrical or polygonal configuration surrounding a central double tapered conical moon pool and contains water ballast and oil and/or liquefied gas storage compartments. The exterior side walls of the polygonal hull have flat surfaces and sharp corners to cut ice sheets, resist and break ice, and move ice pressure ridges away from the structure. An adjustable water ballast system induces heave, roll, pitch and surge motions of the vessel to dynamically position and maneuver the vessel to accomplish ice cutting, breaking and moving operations. The moon pool configuration provides added virtual mass capable of increasing the natural period of the roll and heave modes, reduces dynamic amplification and resonance due to waves and vessel motion, and facilitates maneuvering the vessel. The vessel may be moored by a disconnectable buoyant turret buoy which is received in a support frame at the bottom of the moon pool and to which flexible well risers and mooring lines are connected.

DESCRIPTION OF THE PREFERRED EMBODIMENTS

Figure 1:
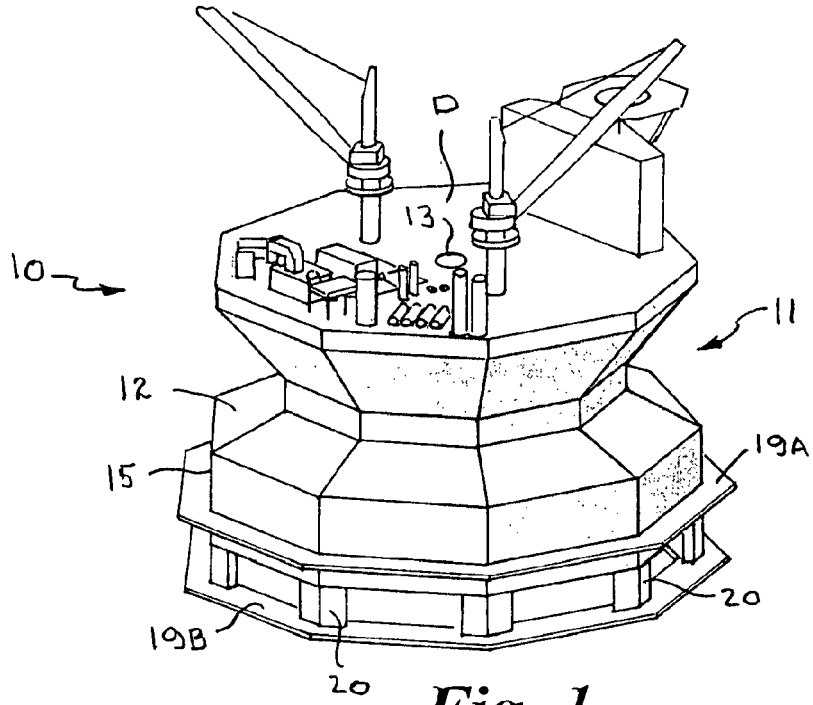
FIGS. 1 and 2 are a perspective view and a top plan view, respectively, of a first embodiment of the offshore floating vessel in accordance with the present invention having a polygonal exterior configuration with flat side surfaces and sharp corners, shown with production facilities on the top deck.
Figure 2:
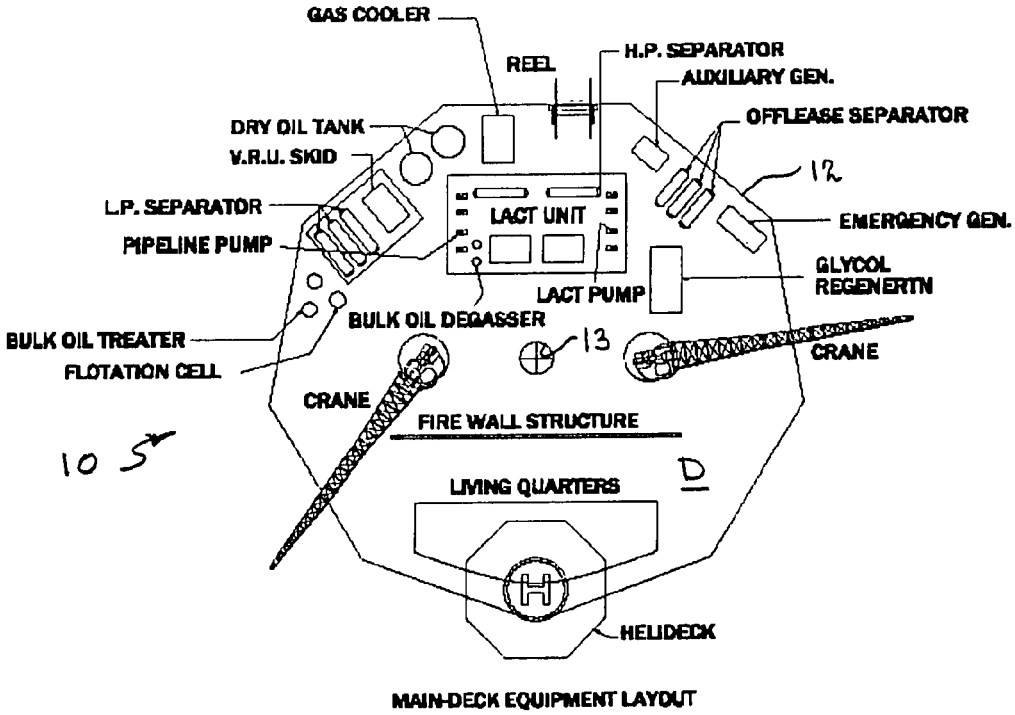
Figure 3:
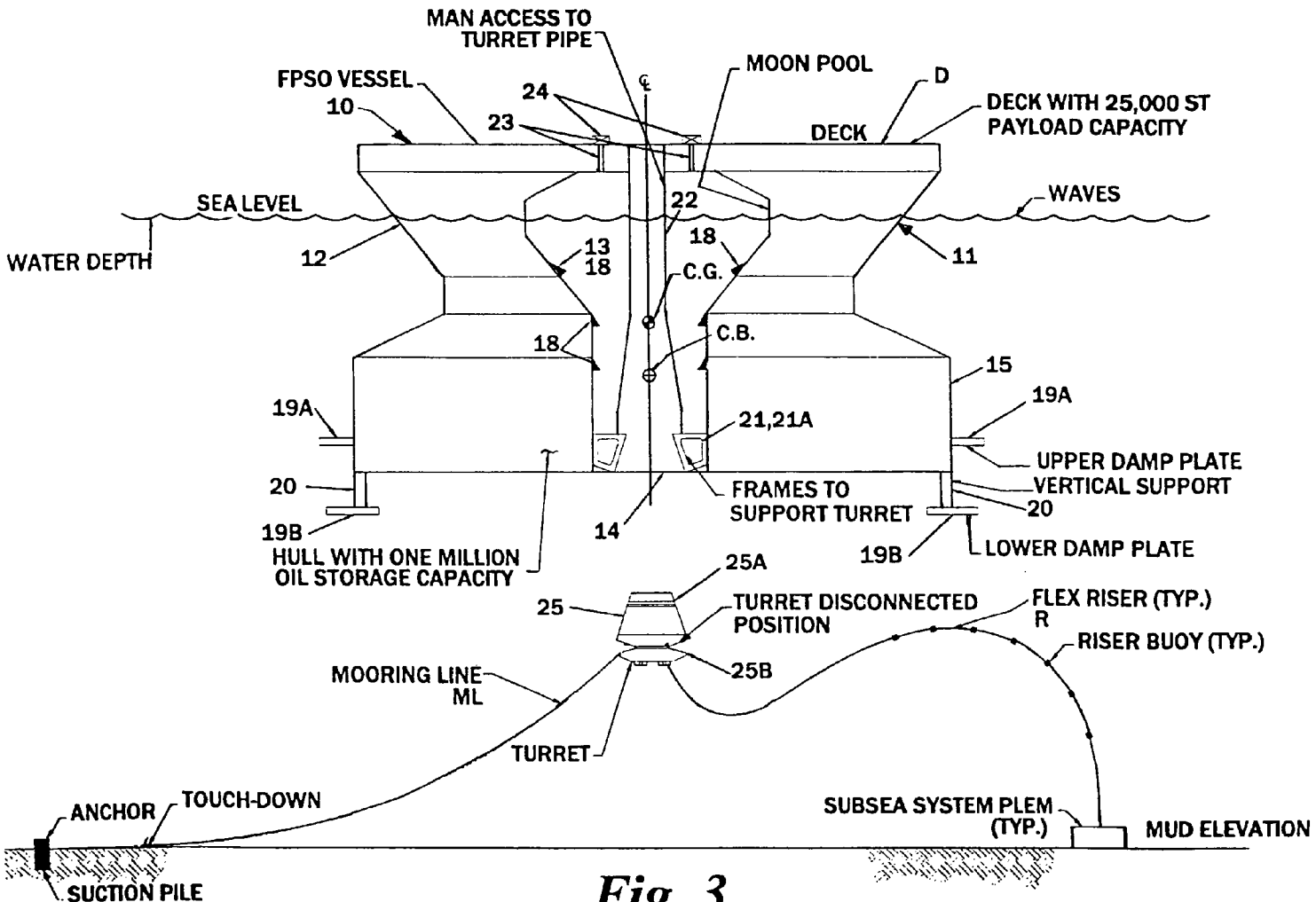
FIGS. 3 and 4 are schematic side elevation views of the vessel, showing the moon pool and disconnectable turret buoy in the disconnected and connected position with risers and mooring lines attached.

Referring now to the drawings by numeral of reference, there is shown, somewhat schematically, in FIGS. 1 through 8, a preferred embodiment of the offshore floating production, storage, and off-loading vessel 10. The vessel 10 has a monolithic non ship-shaped hull 11 of polygonal configuration formed of steel plate surrounding a central double tapered conical moon pool 13. The exterior side walls 12 of the hull 11 have flat surfaces and sharp corners to cut ice sheets, resist and break ice, and move ice pressure ridges away from the structure, as described hereinafter. The exterior walls 12 may be of double walled construction. In a preferred embodiment, the polygonal hull configuration has an uneven number of sides, such as a nine-sided polygon or "nonagon". The central moon pool 13 may also be a polygonal double tapered conical configuration with an uneven number of flat sides and corners, or it may be a double tapered conical generally cylindrical configuration with cylindrical side walls. The structure has a bottom wall 14 surrounding the bottom end of the moon pool 13, and a top wall defining an upper deck D surrounding the top end of the moon pool 13 for accommodating topside drilling and/or production equipment and living quarters. The central moon pool 13 provides for well and riser access and performs additional functions, as described hereinafter.

Figure 4:
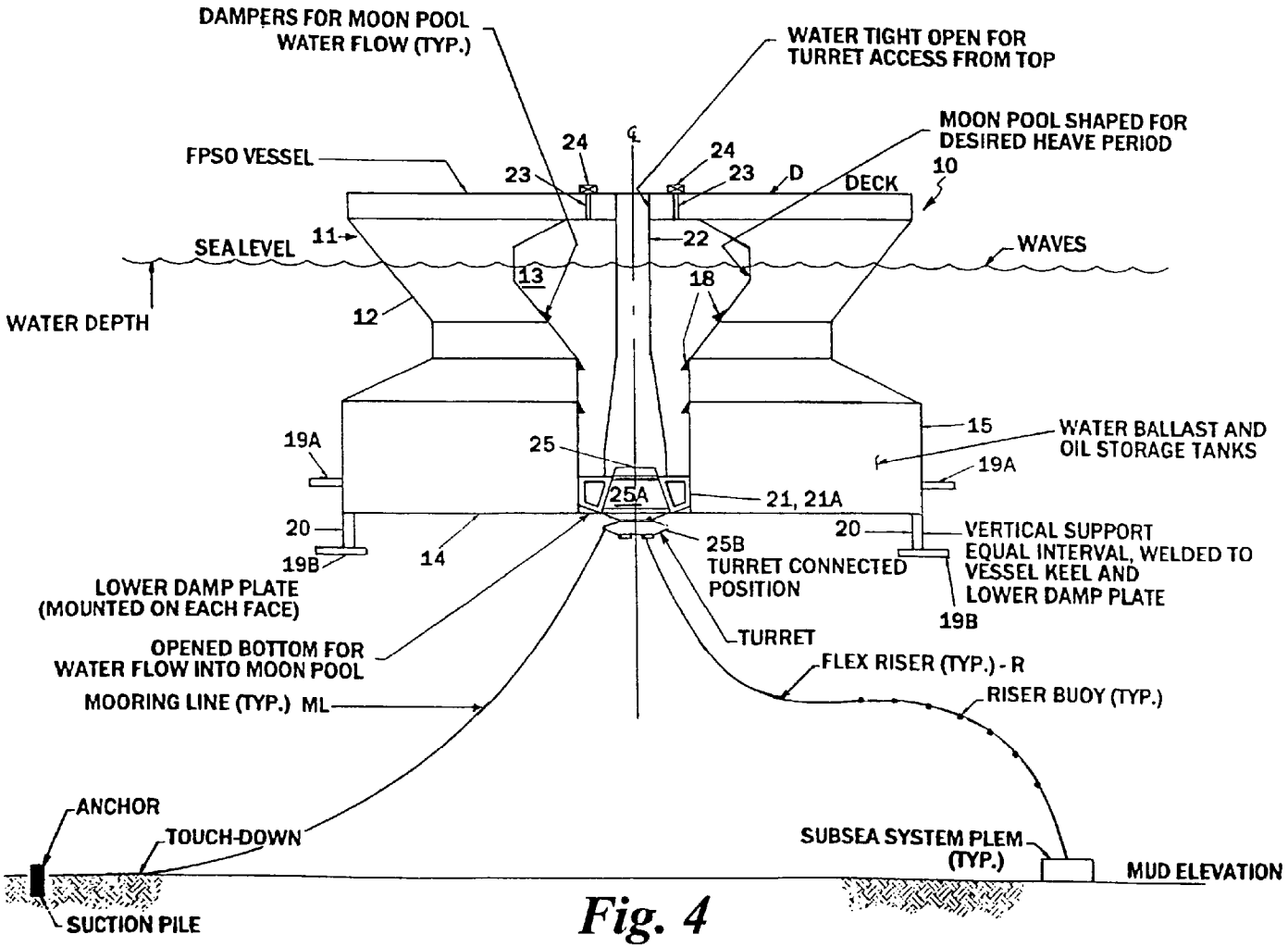
Figure 5:
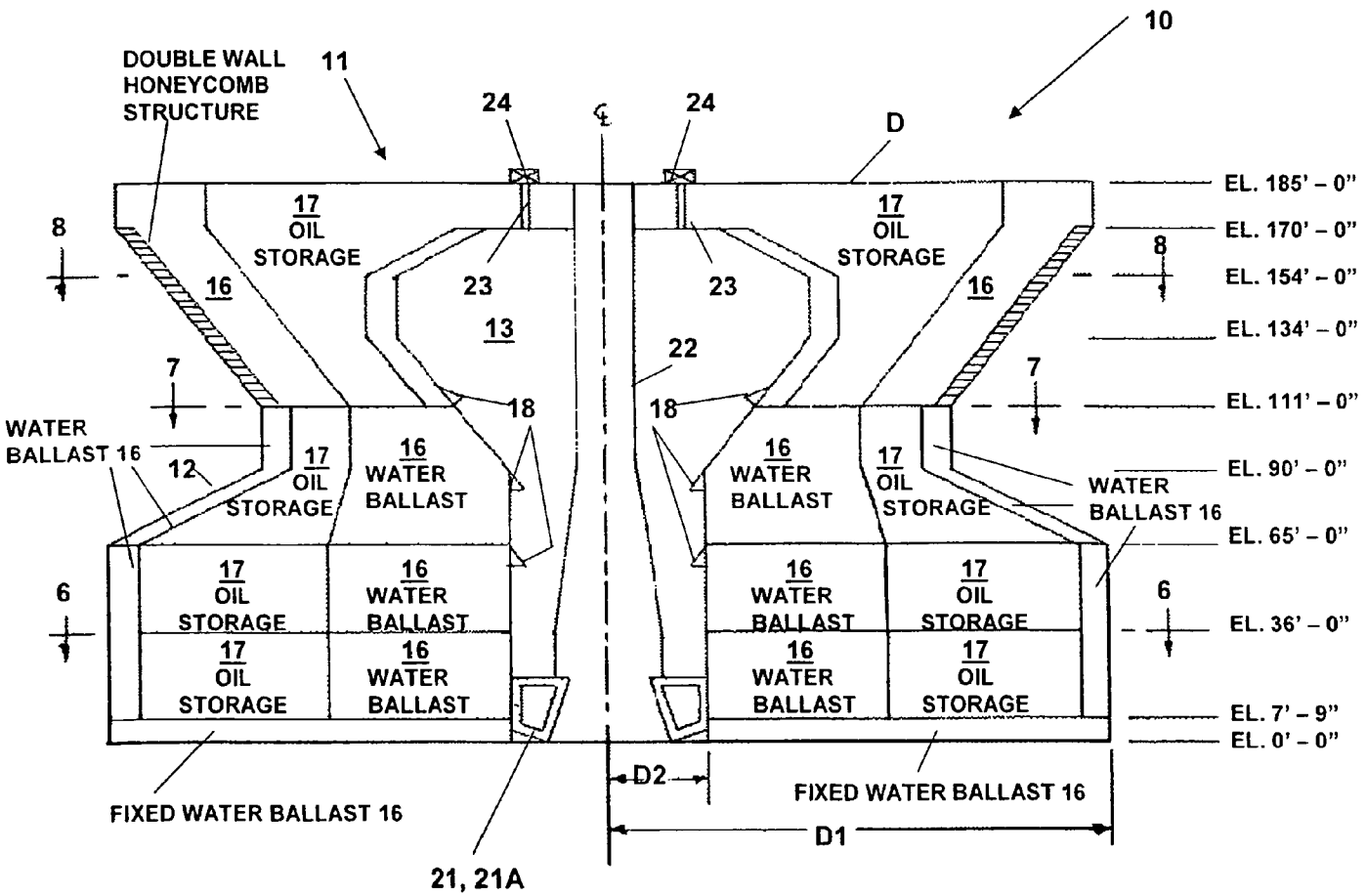
FIG. 5 is a longitudinal cross sectional view of the vessel, showing the moon pool and the internal water ballast and oil storage compartments.
Figure 6:
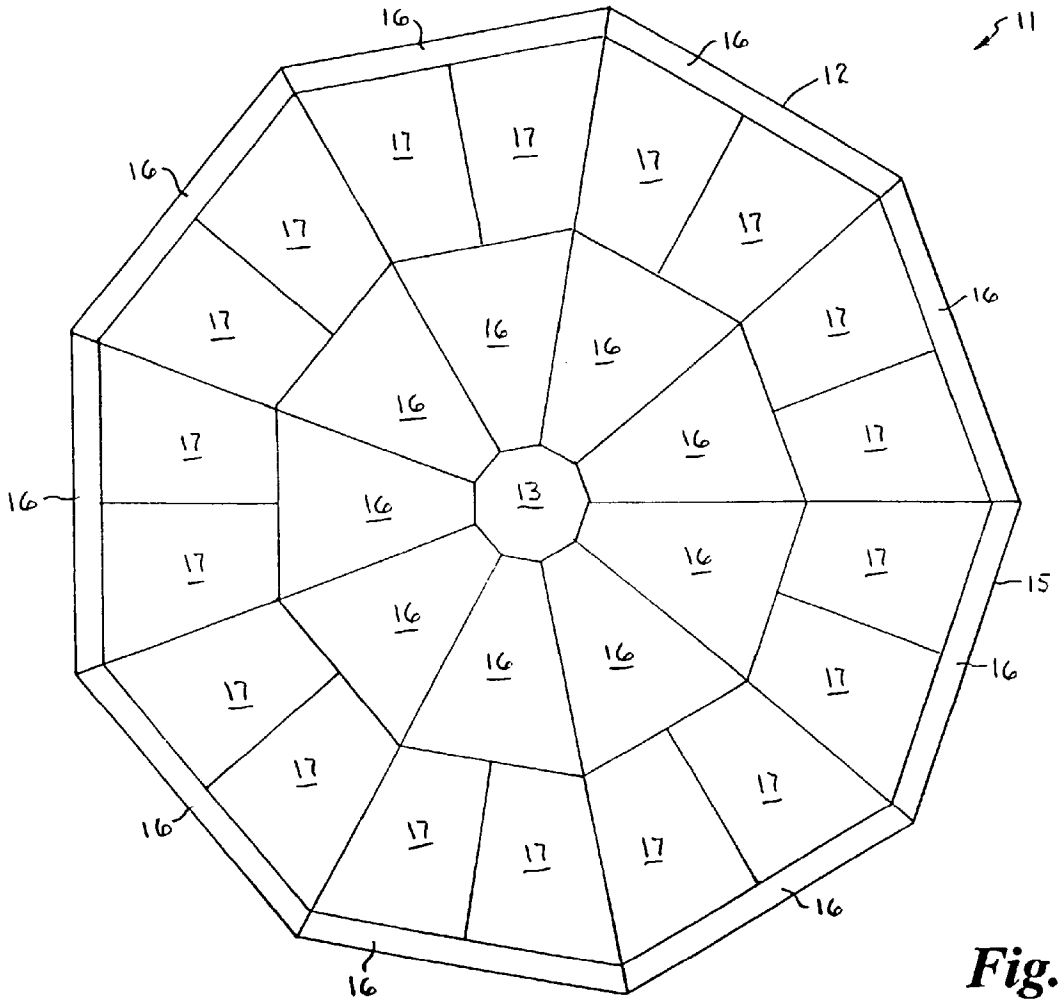
FIGS. 6, 7 and 8 are transverse cross sectional views of the vessel, showing the moon pool and the internal water ballast and oil storage compartments taken along lines 6-6, 7-7, and 8-8 of FIG. 5.
Figure 7:
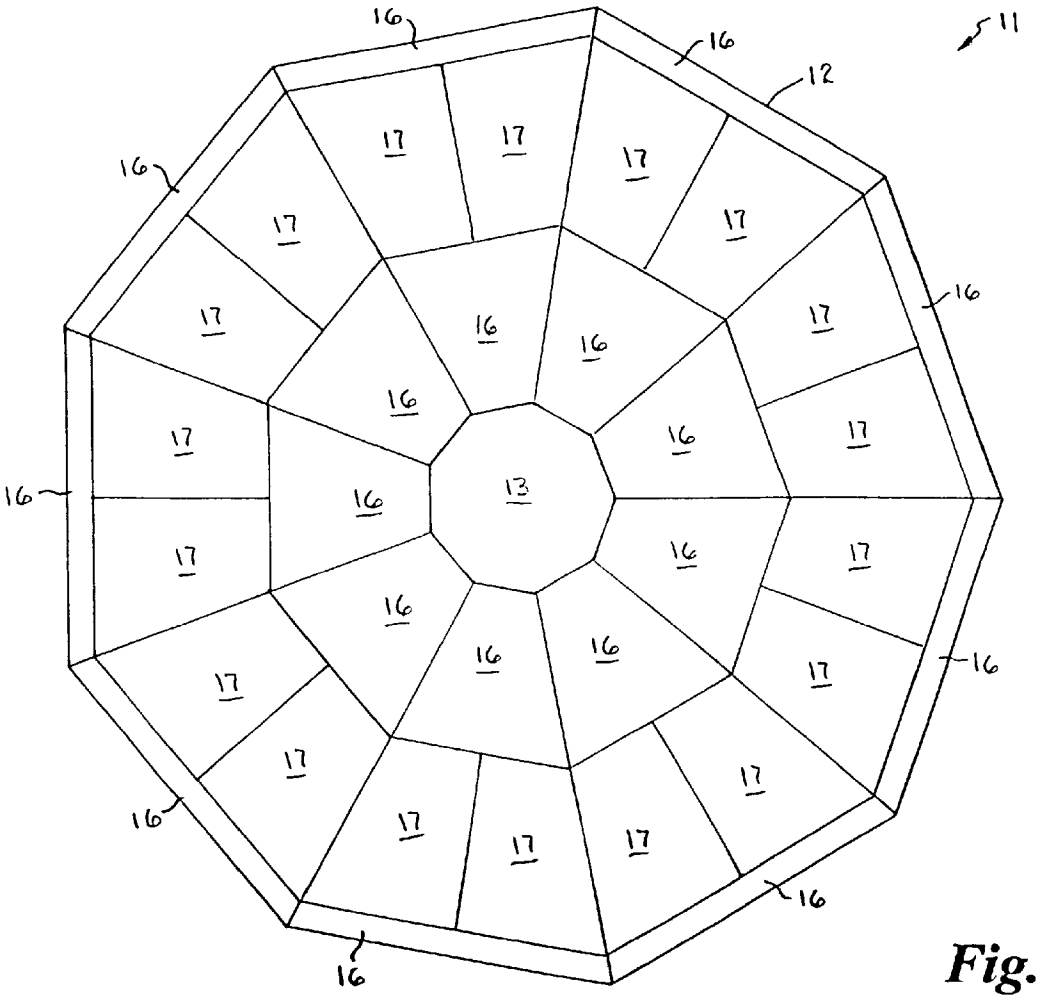
Figure 8:
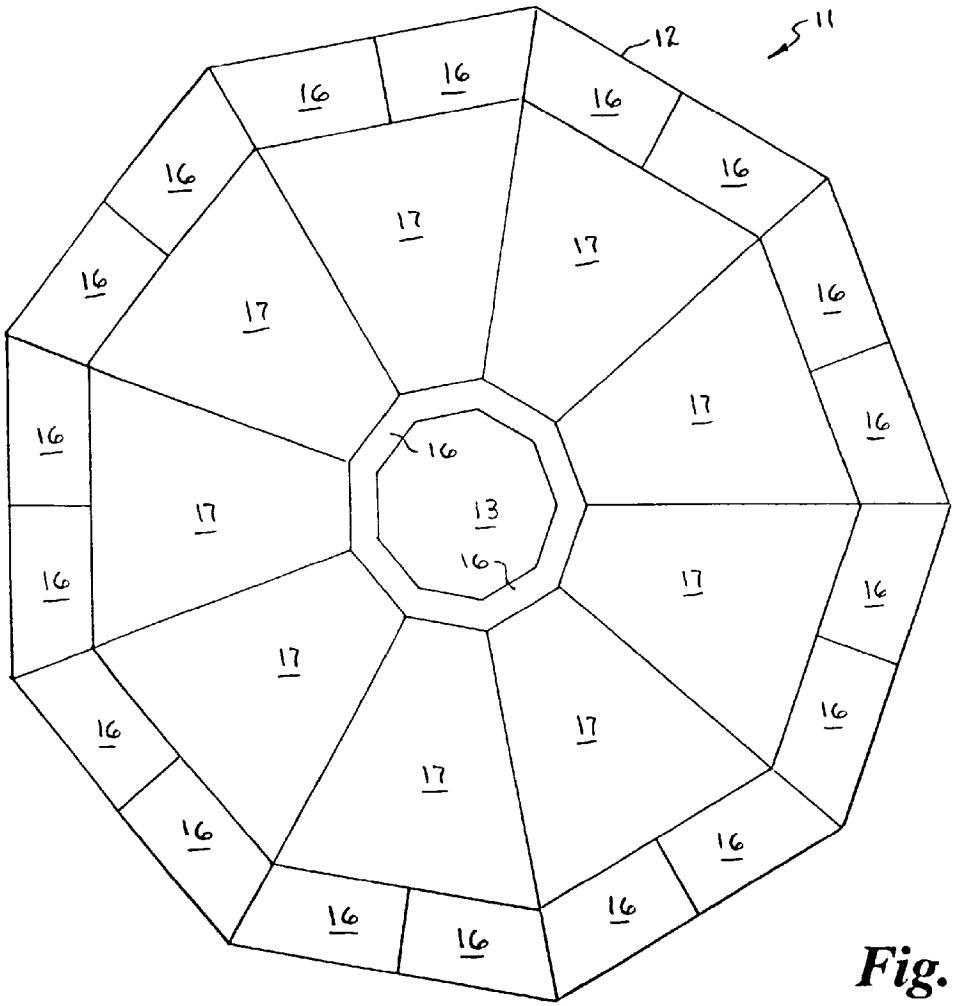
Figure 9:
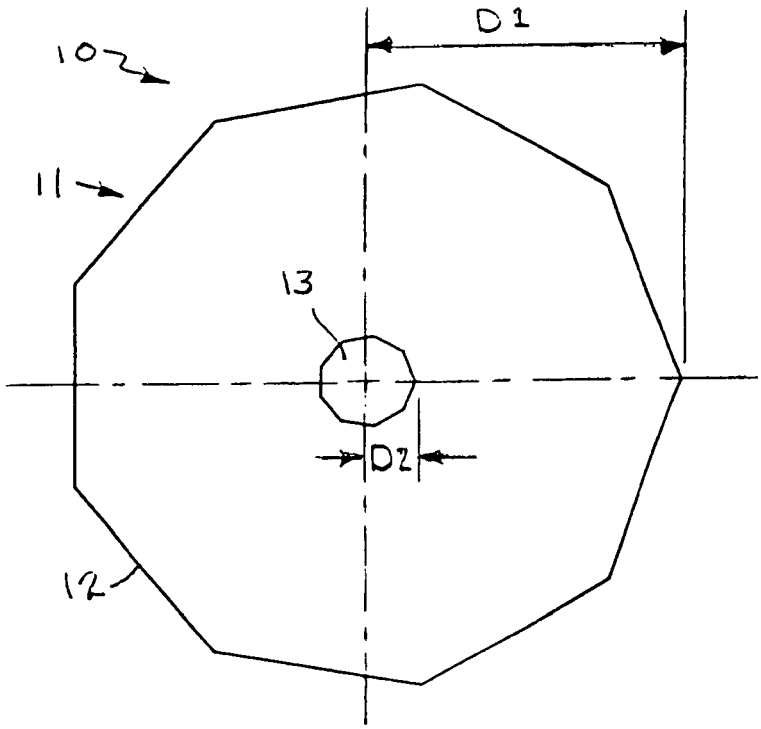
FIG. 9 is a schematic top plan view of the vessel illustrating the dimensions from the center of the moon pool to the outer exterior corners of the hull and from the center of the moon pool to the outer corners of the moon pool, corresponding to table 1.
Figure 10:
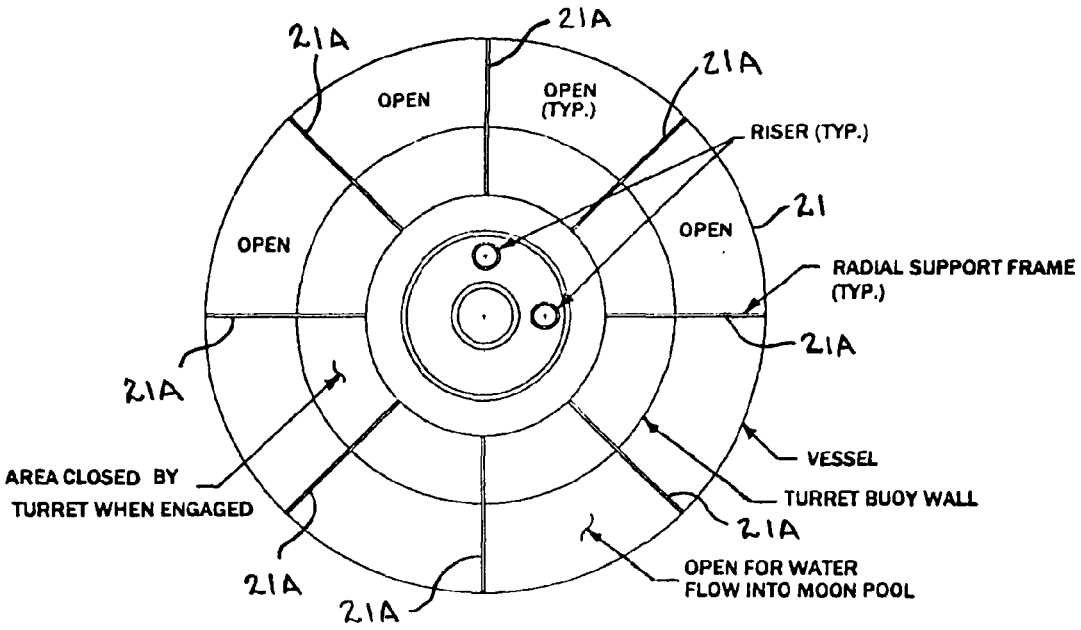
FIG. 10 is a transverse cross sectional views of the turret support frame.
Figure 11:
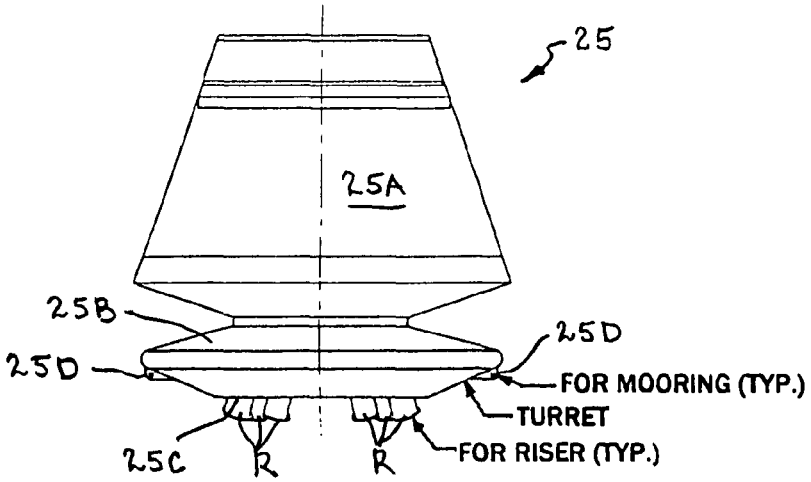
FIG. 11 is a side elevation of the transverse cross sectional views of the disconnectable turret buoy showing the mooring line connectors and risers attached to the bottom portion.

The side of a typical preferred embodiment of a vessel and the relationship of its moon pool having a nine-sided polygon or "nonagon" configuration are illustrated schematically in FIGS. 4, 5 and 9 and shown in table 1 below. The dimensions in column D1 are the distance from the center of the moon pool 13 to the outer exterior corners or vertices of the hull 11, and the dimensions D2 are the distance from the center of the moon pool to the outer corners or vertices of the moon pool.

TABLE 1

| Elevation ft | D1 - Outside Vertices ft | D2 - Inside Vertices ft | Description |
|---|---|---|---|
| 0 | 171' | 32'-6" | Keel |
| 65 | 171' | 32'-6" | Fair Lead Level |
| 90 | 118'-6" | 32'-6" | |
| 111 | 118'-6" | Tapered outward | |
| 134 | Tapered outward | 70' | |
| 144 | Tapered outward | 70' | Still Water Level |
| 154 | Tapered outward | 70' | |
| 170 | 167 | Tapered inward to 39' | Bottom Main Deck |
| 185 | 167 | Horizontal to 10' | Top of Main Deck |

The exterior lower end of the structure has a polygonal keel section 15 with side walls that extend vertically upward from the bottom end to an elevation of about 65 feet and have a lateral dimension from the center of the structure to the outer exterior corners of about 171 feet, and then extend angularly inward and upward to define a smaller section having a lateral dimension of about 118.5 feet at an elevation of about 90 feet and the smaller section continues vertically upward to an elevation of about 111 feet. The exterior side walls then extend angularly upward and outward from the smaller section to an elevation of about 170 feet and a lateral dimension from the center of the structure to the outer exterior corners of about 167 feet and continue vertically upward to an elevation of about 185 feet terminating at the top wall and defining the main deck section. The still water level is located on the upward and outward extending section at an elevation of about 144 feet. The smaller vertical section and the upper and lower sloping surfaces entrap water to provide added hydrodynamic virtual mass to increase the natural period of the roll and heave modes, reduce dynamic amplification and resonance due to waves and vessel motion, and facilitate maneuvering the vessel, as described hereinafter.

The polygonal moon pool opening 13 at the center of the structure has side walls that extend vertically upward from the bottom end to an elevation of about 90 feet and have a lateral dimension from the center of the structure to the outer corners of about 32.5 feet, and then extend angularly upward and outward to a lateral dimension of about 70 feet at an elevation of about of about 134 feet and then vertically upward to an elevation of about 154 feet. The moon pool side walls then extend angularly upward and inward from the vertical section to a lateral dimension of about 39 feet and adjoin a horizontal wall at an elevation of about 170 which is approximately 15 feet below the elevation of the top wall of the main deck section (185 feet). The space between the interior walls (moon pool) and exterior walls 12 form a large volume area surrounding the moon pool, which is divided into a plurality of separate ballast compartments 16 and oil and/or liquefied gas storage compartments 17. It should be noted that the maximum lateral dimension (or width) of the upper vertical portion of the moon pool (about 70 feet from the center at an elevation of about 134 feet to 154 feet) is at approximately the same elevation (about 144 feet) as the still water level located on the upward and outward extending exterior side walls. Thus the configuration of the moon pool 13 provides large ballast and storage areas and a maximum area at an upper end to provide hydrodynamic virtual mass, as described hereinafter.

The interior of the moon pool 13 is provided with a plurality of inwardly facing vertically spaced baffle plates 18 or other damping means to reduce resonance due to the waves and vessel motion. The vessel has an operating draft at 140 ft. and during transport it has a 32 ft. draft.

A series of horizontal upper damping plates 19A are secured to the exterior side walls of the lower end of the structure, and a series of horizontal lower damping plates 19B are secured a distance below the upper damping plates and below the bottom of the hull by vertical support members 20 welded to the bottom of the structure. The horizontal upper and lower damping plates 19A and 19B entrap water to provide added hydrodynamic virtual mass to increase the natural period of the roll and heave modes, reduce dynamic amplification and resonance due to waves and vessel motion, and facilitate maneuvering the vessel, as described hereinafter.

A turret support frame 21 formed of a series of circumferentially spaced plates 21A is disposed inside the bottom end of the moon pool 13, and a central casing 22 extends vertically upwardly from the turret support frame through the horizontal wall at the top of the moon pool and is secured to the top deck D to provide a water tight seal at the top of the moon pool. In this embodiment, the circumferentially spaced plates of the turret support frame 21 allow water to enter the interior of the moon pool 13 from the bottom end and into the annulus between the outside diameter of the casing 22 and interior of the moon pool. Air conduits 23 extend through the horizontal wall at the top of the moon pool 13 and to the top deck D and are connected with pressure control valves 24.

The vessel may be moored either by a catenary line anchor system or dynamically positioned in ice-covered water by means of a disconnectable buoyant two-piece swivel or turret buoy 25 which is received in the turret support frame 21 at the bottom of the moon pool 13. The swivel or turret buoy 25 has a conical upper portion 25A and a bottom flange portion 25B which rotate or swivel with respect to one another. The bottom flange portion 25B has riser connections 25C for connecting flexible well risers R and mooring line connections 25D for connecting mooring lines ML. Riser connections extend upwardly through the central casing 22 in the moon pool to the top deck. The central casing 22 provides access to the turret buoy 25 and aids in providing overall structural rigidity to the platform. The central casing 22 also diminishes the resonance oscillation of the water inside the moon pool, as described hereinafter.

The turret buoy 25 may be freely rotatable or may be locked in a desired position. For example, in arctic conditions in ice covered waters, each side of the vessel could be exposed periodically and controlled for each winter season and thus the fatigue life of the icebreaker sidewalls could be extended. The disconnectable turret buoy 25 can be disconnected from the vessel during emergency conditions, such as a severe winter/summer storm. Alternatively, the turret buoy may be permanently connected to the vessel.

Figure 12:
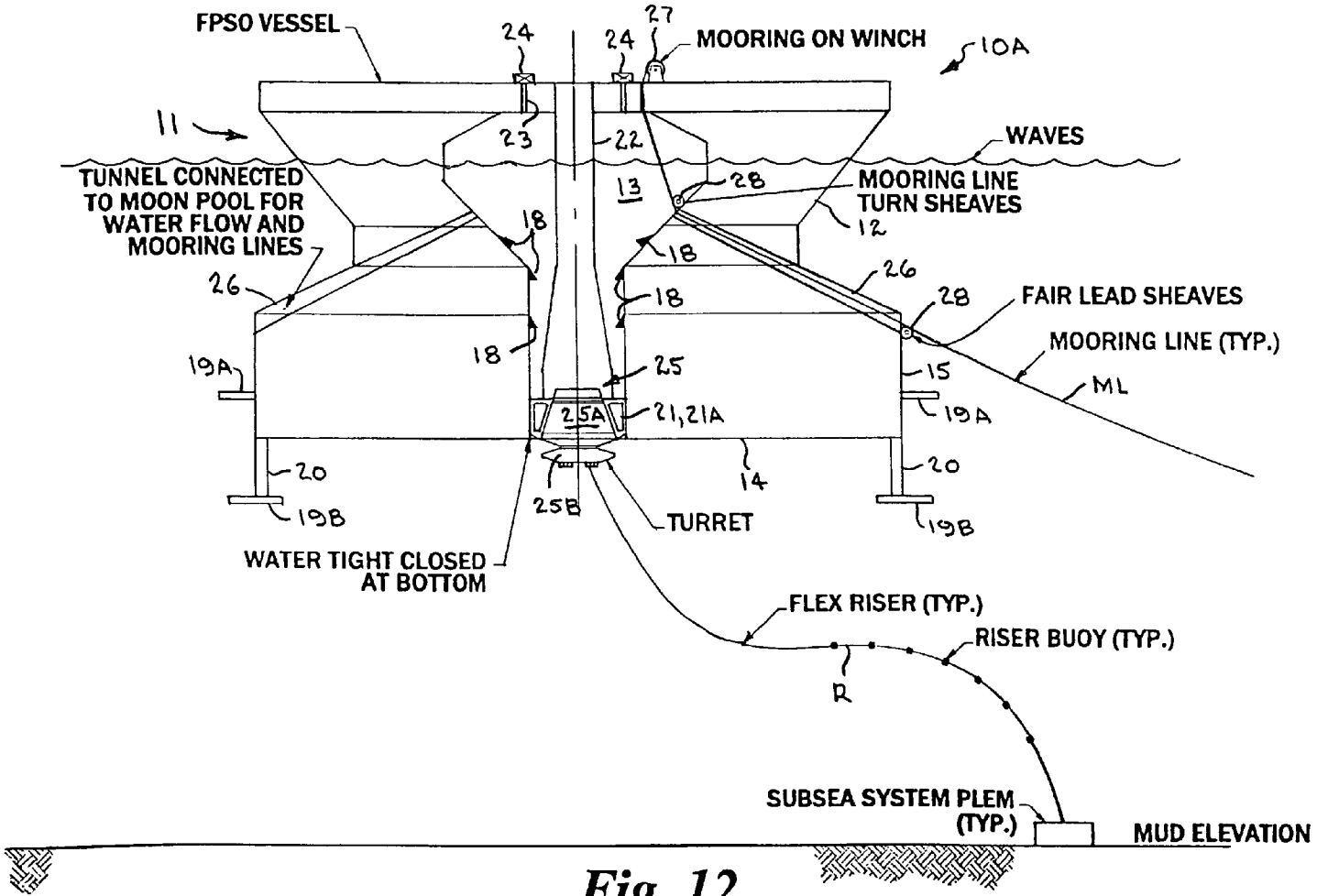
FIG. 12 is a schematic side elevation view showing a modification of the vessel, having water entry and mooring line tunnels extending from the moon pool to the exterior.

FIG. 12 shows a modification of the offshore floating vessel 10A wherein the turret support frame 21 is configured to engage the upper portion 25A of the turret buoy 25 in a water tight relation to prevent water from entering the bottom end of the moon pool around the turret buoy and channels or tunnels 26 extend angularly downward and outward from the interior of the moon pool 13 to the exterior of the hull 11 to allow water to enter the moon pool from the exterior. Also in this modification, the mooring lines ML extend from winches 27 on the deck D, through the deck, and the interior of the moon pool 13 and outwardly through the channels or tunnels 26, supported by fairlead sheaves 28 at each end of the channels or tunnels. The components previously described above are assigned the same numerals of reference, but will not be described in detail again here to avoid repetition.

Figure 13:
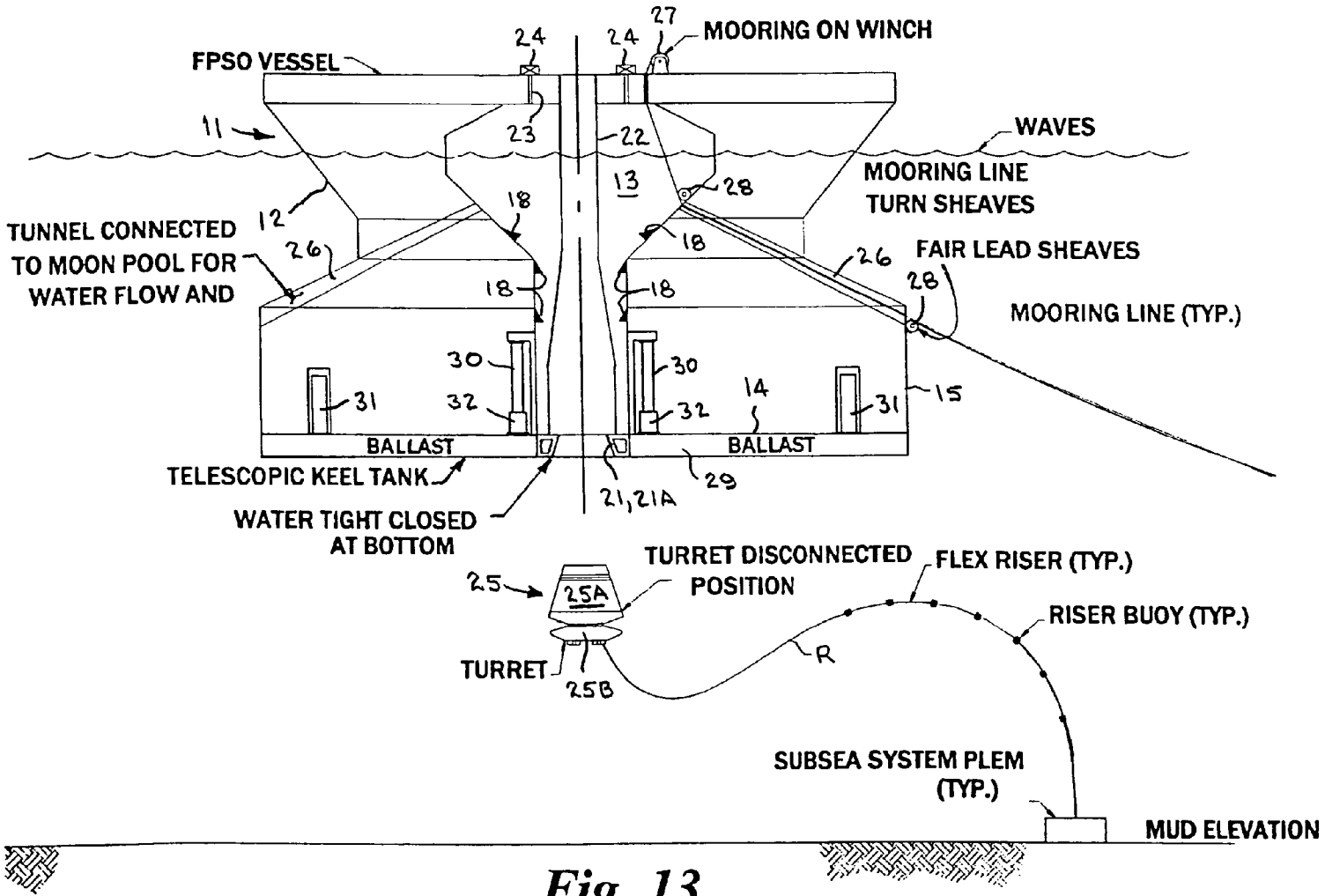
FIGS. 13 and 14 are schematic side elevation view of another modification of the vessel having water entry and mooring line tunnels extending from the moon pool to the exterior, and a telescoping keel tank, shown a retracted and extended position, respectively.
Figure 14:
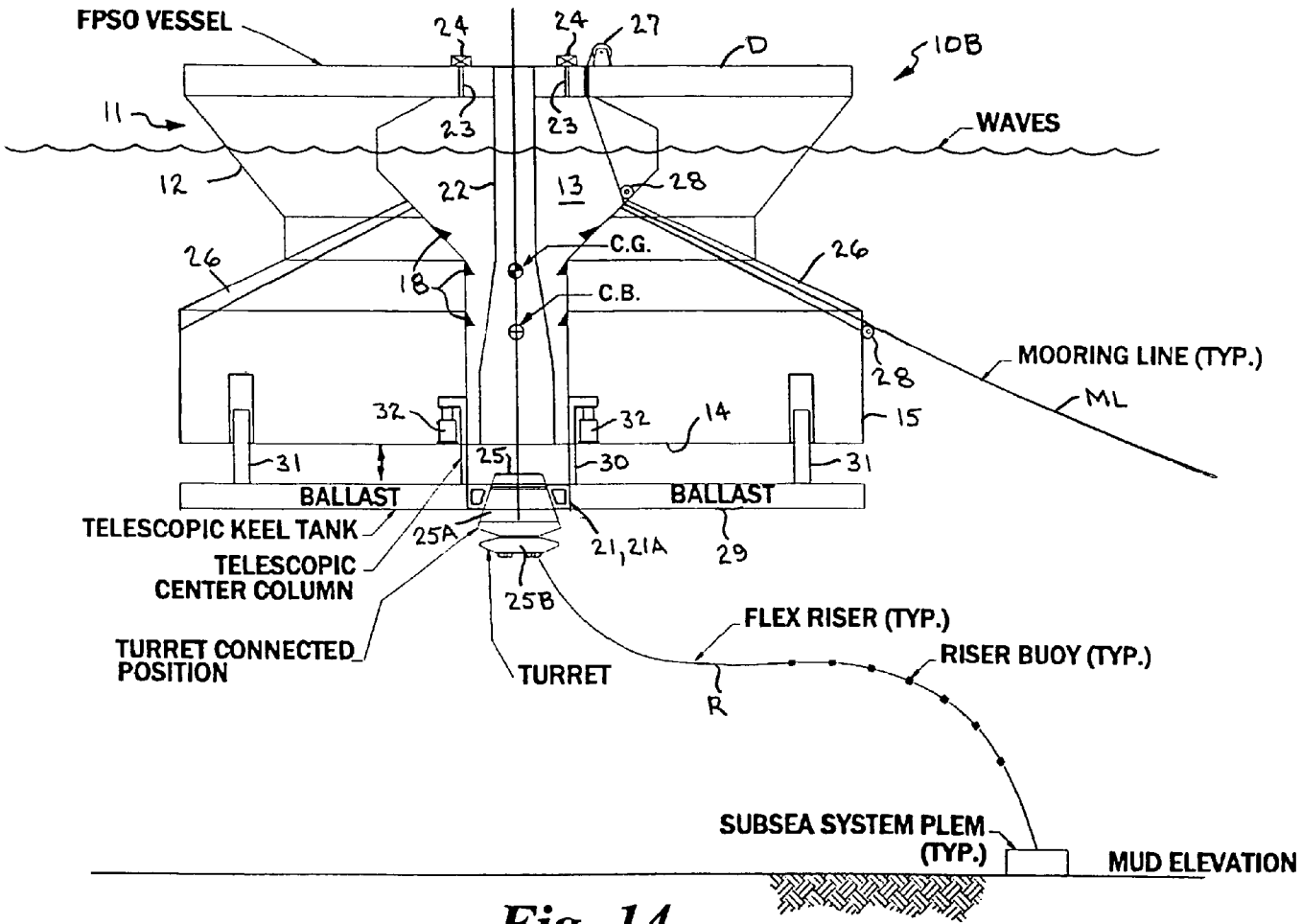

FIGS. 13 and 14 show another modification of the offshore floating vessel 10B having a turret support frame 21 configured to engage the upper portion 25A of the turret buoy 25 in a water tight relation to prevent water from entering the bottom end of the moon pool and channels or tunnels 26 extend angularly downward and outward from the interior of the moon pool to the exterior of the hull, as described above, wherein the mooring lines extend from winches 27 on the deck, through the deck, and the interior of the moon pool and outwardly through the channels or tunnels 26, supported by fairlead sheaves 28 at each end of the channels or tunnels. The components previously described above are assigned the same numerals of reference, but will not be described in detail again here to avoid repetition.

This modification has a vertically adjustable telescoping fixed ballast keel tank 29 at the bottom of the structure, shown in a retracted position and an extended position, respectively. The telescoping keel tank 29 is adjoined to the hull structure 11 by a central hollow column 30 and circumferentially spaced vertical guide tubes 31 spaced outwardly therefrom that are slidably mounted in the lower end of the hull. The keel tank 29 is extended and retracted by hydraulic cylinders 32 mounted in or on the hull. The central hollow column 30 forms a water tight extension of the bottom portion of the moon pool 13. In this modification, the turret support frame 21 is disposed in the center of the keel tank 29 and configured to engage the upper portion 25A of the turret buoy 25 in a water tight relation. The support frame 21 and surrounding central hollow column 30 prevent water from entering the bottom end of the moon pool 13 around the turret buoy 25.

When the keel tank 29 is extended, water in the space between the bottom wall 14 of the hull 11 and the top of the keel tank serves as added hydrodynamic virtual mass to increase the natural period of the roll and heave modes, reduce dynamic amplification and resonance due to waves and vessel motion, and facilitate maneuvering the vessel, as described hereinafter.

Figure 15:
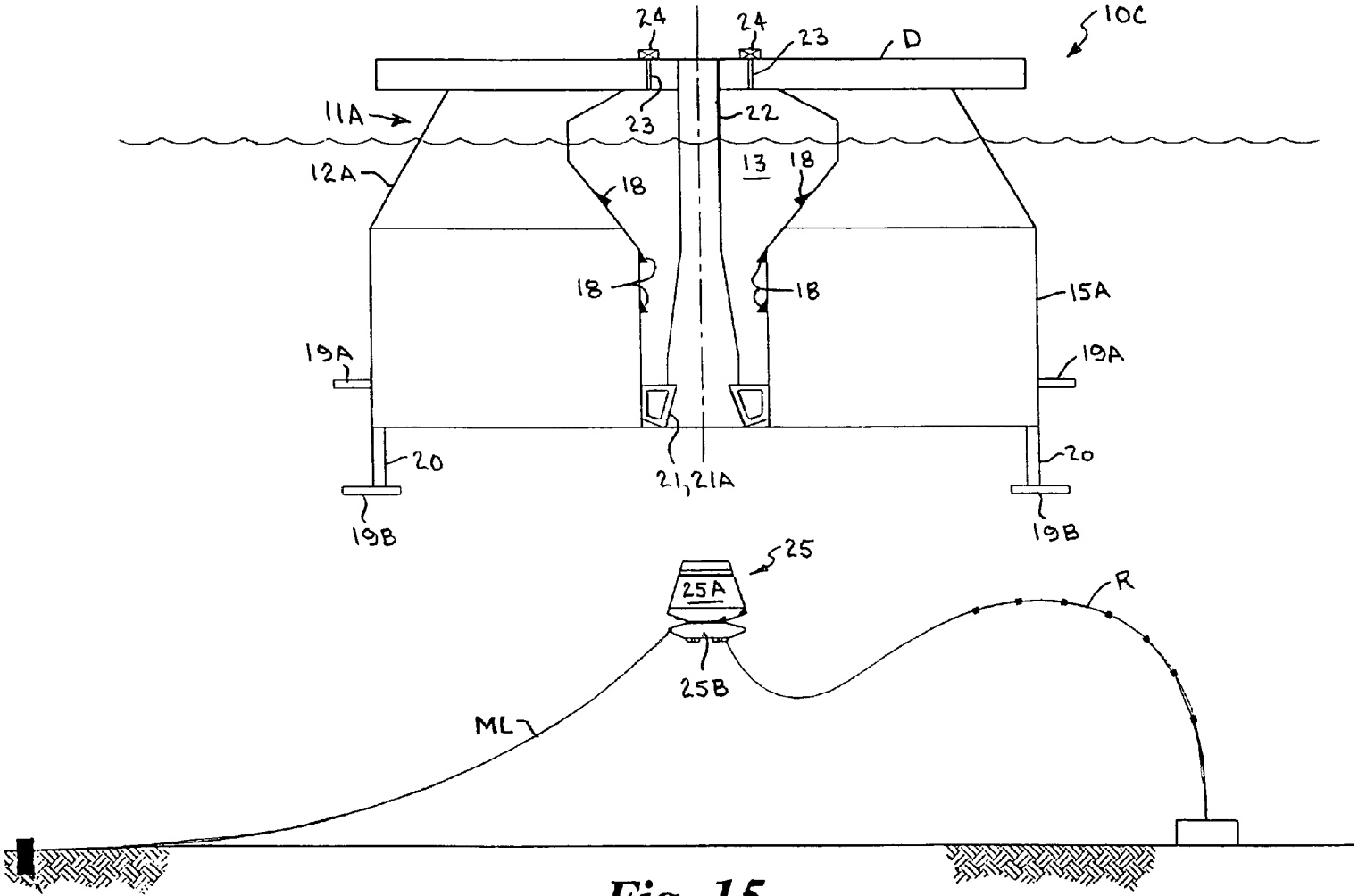
FIG. 15 is a schematic side elevation view of second embodiment of the vessel suitable for use in clear water applications.

FIG. 15 shows another embodiment of the offshore floating vessel 10C that is designed to support drilling/production/storage/off-loading operations in clear water and/or deep depth applications with no ice around. The vessel 10C has the double tapered conical moon pool 13 as described previously, a turret support frame 21 configured to engage the upper portion 25A of the turret buoy 25 to allow entry of water through bottom end of the moon pool, and the upper and lower damping plates 19A and 19B, wherein the mooring lines ML and risers R extend from the bottom portion of the turret buoy 25, as described above. The components described previously are assigned the same numerals of reference, but will not be described in detail again here to avoid repetition. In this embodiment, the exterior lower end of the structure has a longer lower keel section 15A with side walls 12A that extend vertically upward from the bottom end and then extend angularly inward and upward to terminate at the bottom wall of the main deck D. The still water level is located on the upward and inward extending section at an elevation of about 144 feet and the maximum width of the double tapered conical moon pool 13 is disposed at about the still water elevation to provide added hydrodynamic virtual mass to increase the natural period of the roll and heave modes, reduce dynamic amplification and resonance due to waves and vessel motion, and facilitate maneuvering the vessel. The exterior side walls 12A and moon pool 13 of the floating vessel 10C may be of a polygonal configuration, or the vessel may have a generally cylindrical exterior configuration.

Having described the major components of the preferred embodiments of the offshore floating production, storage, and off-loading vessel, the following discussion will explain in more the interaction of the components in carrying out the operation of the vessel.

Principles of Stability and Motion

The principles of stability and motion of the present floating vessel is based primarily on naval architecture stability and motion criteria. Pitching, rolling and heaving motion undergo cyclic accelerations which predominantly control the design of an offshore vessel from the naval architect point of view. If the vessel's heave/pitch/roll periods become closer in the neighborhood of the wave/wind/ice exciting energy spectrum, then the system is susceptible to direct wave/wind/ice energy at resonance, leading to large motions and fatigue difficulties. Thus a vessel design is tuned simultaneously between the stability criteria and the motion criteria. The design factors affecting the stability criteria and the motion criteria of a floating vessel are the center of gravity "cg", the center of buoyancy "cb", the metacenter M, the meta centric height "GM", the area of the water plane "AW", the mass of the oscillating body "m" with its virtual mass.

The stability of a floating vessel is defined as its ability to return to the original position after it has been disturbed from its even floating situation by wind, wave, and current and ice environmental horizontal loads. If the floating vessel returns to its original position of equilibrium after the disturbance of the environmental forces, then the vessel is in a stable condition. There are two types of stability designs in the concept of offshore floating vessels: one in which the "cg" of the vessel is kept below the "cb". In the second case the "cg" of the vessel is kept above the "cb" and the metacenter is controlled by the water plane area and the area moment of inertia of the water plane area.

The metacenter point M of a floating vessel is defined as an intersection of two lines of action of the buoyancy force at two inclinations of the floating vessel apart. The distance from cg to M is called GM. Generally, the larger positive value of the GM, the safer the stability of the body.

On the other hand, the rotational motions circular frequency (pitch/roll) is defined as:

$$\Omega_n=\sqrt{(g*GM/KG^2)} \quad \text{Equation (1)}$$

where "KG" is the distance of the cg from the keel of the vessel and "g" is the gravitational acceleration which is a constant.

The above equation says that although the larger GM provides extra stability to the floating vessel it would also increase the rational motion frequency of the vessel.

The heave natural frequency of the vessel is given by the following formula:

$$\omega_n=\sqrt{(\rho*AW/m)} \quad \text{Equation (2)}$$

Where ρ is the specific weight of water in which the vessel is floating.

The Moon Pool Design

In the second above equation for a given floating vessel of mass "m", the heave natural frequency decreases as the water place area "AW" of the vessel decreases.

In the present invention, water is allowed to flow through the moon pool 13 either thorough the bottom of the vessel or through the side tunnels 26 depending on the exemplary embodiments described above. A smaller water plane area with larger area of moment of the water plane is possible with the double tapered conical moon pool shape. The conical moon pool shape of the vessel 10 has the widest portion of the moon pool 13 disposed near the still water surface and the narrower lower portion disposed at the keel of the vessel. The larger and wider open area in the upper portion of the moon pool 13 near the still water surface increases the natural period of the vessel effectively, and the smaller and narrower open area in the lower portion near the keel increases the oil storage capacity of the storage compartments of the vessel and makes this vessel economical for oil and gas production development utilizations. Thus, the storage capacity of the present non-ship-shaped FPSO vessel is comparable to the storage capacity of a conventional ship-shaped FPSO.

Since the water plane area is kept at a maximum distance from the central vertical axis of the vessel, the maximum moment of inertia is utilized well in this design. Removing the water plane area at the middle near the center vertical axis would not significantly affect the overall moment of inertia of the vessel provided by the total water plane area moment of inertia given to the vessel if the open bottom keel were closed. On the other hand, the decrease in the water plane area by removing the water plane area near the center at the still water surface has increased the natural period of the vessel. Thus, the present floating vessel is tuned to have heave periods in the range of 18 sec to 25 sec. Such increased natural heave periods are very desirable in the design of an FPSO. It should be noted that conventional ship-shaped FPSO have natural heave periods in the range of 8 sec-12 sec which are susceptible to wave energy commonly seen in the ocean.

Thus, one of the utilitarian features of the present invention is that the natural period of the heave can be increased above the wave energy spectrum periods commonly and predominantly seen in the ocean. Previously this was only possible with TLP, and SPAR types of offshore vessels with no oil storage. Adequate flow of water is established in the double tapered conical moon pool with the bottom open and or side tunnel open. This does not endanger the stability of the vessel. Thus, with the present FPSO it is feasible to have the same, or better, vertical motion characteristics as TLP and SPAR vessels and, furthermore, the FPSO can carry over one million barrels of oil and/or liquefied gas storage which is very economical in deepwater and remote oil and gas development locations where pipeline transports are not feasible.

Disconnectable Turret Mooring Design

The disconnectable turret system is a very valuable feature for an FPSO, particularly when facing severe environments. Disconnecting turrets are used to support the oil production risers R, and to support the mooring lines ML. The turret buoy 25 is buoyant is able to float submerged with the risers R and mooring lines ML attached. In a worst case weather storm scenario, the risers and the mooring lines can be disconnected from the vessel by utilizing the disconnectable turret. The turret may be disconnected from the vessel and the vessel is free to float during a severe storm without harming the risers and mooring system. After the storm, the vessel can be located, towed back to the location, and connected back to the risers and moorings to reestablish production.

In the present floating vessel design, the GM (meta centric height) is maintained higher than normally required for a floating vessel. The GM is set larger to make the vessel extra stable and thus the turret mooring is more easily achieved. The GM of the vessel is increased by fixed ballast provided at the bottom of the keel of the vessel. The telescopic keel tank 29 with fixed ballast is also telescoped down if design demands to increase the GM of the vessel by lowering the cg (center of gravity).

The turret bottom mounted mooring is designed such that the vessel GM is controlled and then the roll/pitch motions of the vessel are excited near resonance to break the ice sheets and ice ridges in the winter condition in an arctic offshore operation. In that case the GM is tuned smaller such that the vessel is sensitive to rock due to the ice load and thus reduces the likelihood of damage of the break the vessel. The bottom mooring support and the top ice loads provide a large lever arm adequate to induce the roll and pitch motion such that the sloped side surfaces of the vessel break the ice in an arctic winter environment. The more ice sheets that are broken, the smaller the ice load transmitted to the structure. Moreover, the risers and the moorings are located at the keel of the vessel and thus not exposed to the surface ice loads. This feature is especially useful for arctic oil and gas development conditions.

Added Virtual Mass

The additional virtual mass feature of the present invention plays a very important role in controlling the wave high frequency responses. In clear water with wind waves, for periods from 0 sec-15 sec, the non-ship-shaped FPSO vessel heave is very negligible and it behaves calm in this sea condition. Several virtual mass devices are designed into the vessel for the heave vertical motion as the vessel oscillates in the vertical direction. The double tapered conical moon pool 13 introduces added virtual mass in the vertical direction. A predominant portion of the water mass entrapped in the conical shape is lifted up with the vessel motion. Similarly, the water mass between the exterior opposed slopping sides in the upper portion of the vessel due to the opposed sloped surfaces provides added virtual mass. Thirdly, the water mass entrapped between the upper and lower damping plates 19A and 19B provided on all sides also increases the added vertical virtual mass of the vessel. Half of the surface of the lower damping plates 19B extend inwardly beneath the outer sides of the keel and their other are half extends outside the sides of the keel of the vessel. Thus virtual water mass is also entrapped between the bottom wall 14 of the keel of the vessel and the bottom damp plates. All these virtual masses supplement the vessel mass in the vertical oscillation and increase the natural heave period of the vessel. They also play an important role in lower wave periods by diminishing the vertical motion.

Damping Devices of the Vessel

The present vessel is designed with several separate flow damping devices. The upper and lower damping plates 19A and 19B can be either preinstalled or installed at the site and are used to control the roll/pitch and heave motion of the vessel. As the vessel roll/pitch/heave the flow in the water media is separated and the energy dissipated into the infinite water media of the ocean and thus these plates are used together or individually to induce separated flow damping to the vessel. There are also damping devices 18 provided on the side wall of the conical moon pool 13 near the keel. These devices separate the flow and provide flow resistances inside the moon pool. Thus, the present design significantly reduces or eliminates the moon pool water resonance. The free water surface inside the moon pool entraps air below the bottom wall of the deck inside the vessel moon pool. This compressed air is compressed and controlled through the pressure controlled valves and thus damps the water resonance inside the moon pool. The upper and lower damping plates 19A and 19B effectively damp the heave, roll and pitch motions of the vessel as they are located at the bottom of the vessel and provide a large lever arm to control the roll/pitch motion excited by the horizontal environmental (ice/wave) forces at the free water surface of the vessel. The damping features also provide external stability to the vessel and thus provide restoring forces to the vessel from the vessel keel. Thus, the damping plates significantly stabilize the motion.

Central Casing of the Vessel

The vertical central casing 22 located at the center axis of the vessel is water tight to the annulus surrounding the moon pool and is structurally strong. The central casing provides a water plane area at the middle of the vessel without significantly contributing to the moment of inertia of the water plane area. Thus it is not controlling the stability of the vessel. The central casing structurally supports the disconnectable turret 25. It also provides water-tight access to the turret vertically from top to bottom, while it is connected to the vessel with mooring lines/flexible risers. The central casing also diminishes the resonance oscillation of the water inside the moon pool. Another feature is that the central casing is supported radially by vertical stiffened plates at the keel level and allows water to flow inside the moon pool. The central casing supported at the top at the deck level and bottom at the keel level also provides overall structural rigidity to the vessel.

Moon Pool Water Entry

In one embodiment, the turret support frame 21 is open at the bottom of the keel allowing water to flow into the moon pool around the sides of the central casing. In another embodiment, the turret support frame is closed and water flows into the moon pool through open side tunnels 26. The advantages of the open side tunnels 26 is that the moon pool resonances are eliminated, and the open tunnels with fairleads located on the sides well below the free water surface may be used for mooring lines. Thus, the mooring lines are protected from surface ice sheets/ridge impacts. The side tunnels 26 allow adequate water flow to the moon pool and keep the vessel stable. In this case the added virtual mass is very large and the vertical heave natural period is increased significantly. Both the open bottom keel and the open side tunnels provide adequate controlled flow of water inside the moon pool and make the vessel stable.

Pressure Control Valves for Moon Pool

Air becomes entrapped inside the moon pool below the deck bottom surface. As the vessel oscillates vertically, the air is compressed and damps the free water surface resonance inside the moon pool. When the pressure exceeds the limit, the valves 24 open up and release the pressure to avoid any damage to the deck.

Telescopic Keel Tank

The telescopic keel tank 29 provides fixed ballast which can be moved relative to the hull during operation. The hollow column 30 surrounding the moon pool 13 and disconnectable turret forms a telescoping extension of the moon pool and moves with the keel tank A small vertical displacement downward moves the cg (center of gravity) of the vessel significantly and thus the GM (meta centric height) of the vessel is increased significantly. Thus the vessel is very stable. In this embodiment, the water flow from the sides of the vessel through the side tunnels to the moon pool keeps the vessel stable, and the bottom of the vessel is water tight such that no water flows to the moon pool thorough the open bottom. When the vessel is transported to the site the keel tank xx is maintained in its retracted position to provide compact height. When moved to the site location, the keel tank is filled with fixed ballast and lowered automatically by the downward pull of the fixed ballast. Then the turret 25 is connected to the vessel as required for the using the vessel for production support and the turret is not connected when the vessel is used as a drilling support vessel. Hydraulic cylinders 32 are located around the central casing to retract the keel tank if needed.

The water entrapped between the bottom of the keel of the vessel and the top of the extended keel tank 29 provides additional virtual mass to increase the natural heave period of the vessel. The separated flow formed around the edges of the telescoping keel tank 29 also produces adequate separated flow damping for the vessel. Thus, the telescoping keel tank embodiment does not need upper and lower damping plates. The damping provided by the space between the two surfaces of the keel of the vessel and the top of the keel tank control the roll/pitch motion of the vessel adequately stabilize the vessel in operation.

Disconnectable Turret System

It is believed that the present vessel is the first time a turret system has been employed in a non ship-shaped FPSO. The turret 25 may be disconnectable or permanently connected, and may be rotatable or locked in a particular position. In the case of an arctic class vessel, each side of the vessel can be exposed periodically and controlled for each winter and thus the fatigue life of the icebreaker side walls can be significantly enhanced. As discussed above, the turret can support mooring lines and flexible risers as required for the vessel, and the disconnectable turret is buoyant and can be disconnected from the vessel during emergency conditions, such as a severe storm.

Dual Mooring System

Figure 16A:
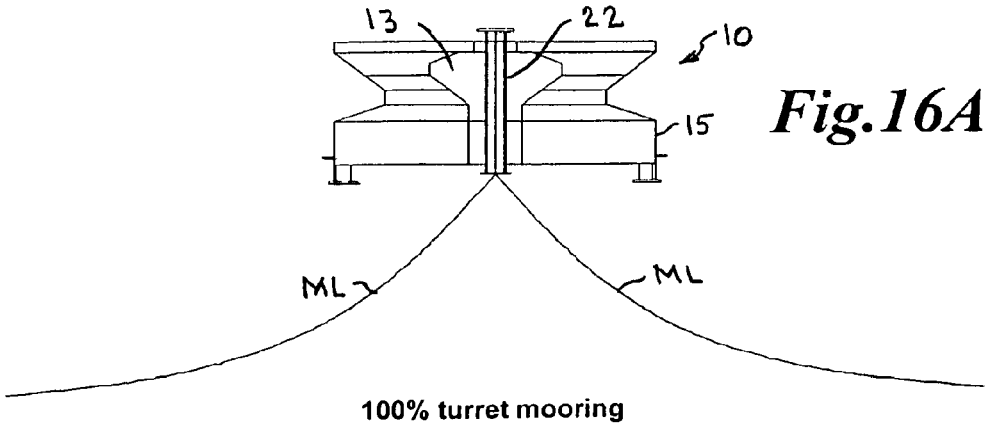
FIGS. 16A, 16B and 16C are schematic side elevation views showing the various mooring arrangements for the vessel
Figure 16B:
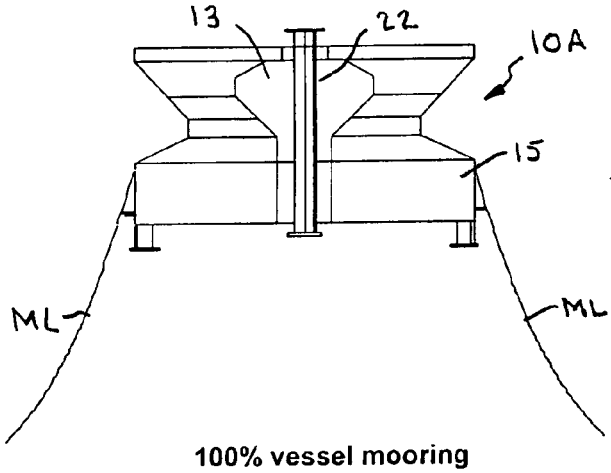
Figure 16C:
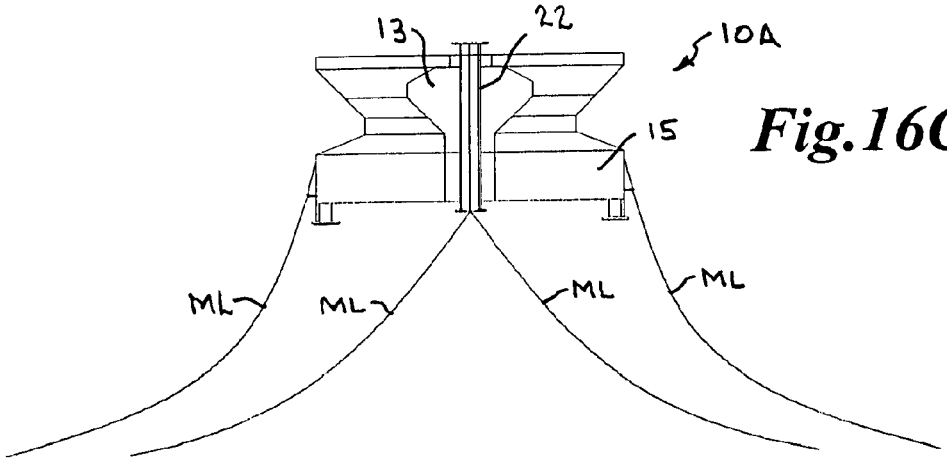

As shown in FIGS. 16A, 16B and 16C, the present vessel has a dual mooring system which is believed to be unique. FIG. 16A shows the vessel 10 with mooring lines ML connected the turret to provide 100% turret mooring, and FIG. 16B shows the vessel 10B with mooring lines ML connected the vessel to provide 100% vessel mooring. FIG. 16C shows a dual mooring system for use in clear water, wherein mooring lines ML are connected both to the turret and to the vessel to provide 50% turret mooring and 50% vessel mooring. The conventional mooring lines are deployed from the deck and the turret moorings are attached to support the turret and flexible risers. The turret mooring demands larger GM (meta centric height) and thus the roll/pitch motions are significant. In that case, the excessive roll/pitch due to the turret moorings can be controlled by the additional conventional moorings.

The motion induced by the horizontal environmental loads near the free water surface and the turret mooring bottom support would induce significant roll/pitch, which is controlled by excessive GM as discussed above. Also such motions are desirable in the case of ice-covered arctic water during winter. However, for clear water conditions during a severe storm, it is not desirable to have large pitch and roll. Hence the conventional mooring provided in addition to the turret mooring effectively controls the roll and pitch. The overturning forces introduced by the turret mooring and the horizontal environmental forces on the vessel near the free water surface is restored and resisted by the conventional moorings provided from the top of the vessel.

This situation is good for clear water summer storm conditions only. In the case of severe waves and storms, the vessel is supported in a station keeping mode by the conventional moorings until the turret with the connected flexible risers are disconnected from the vessel.

Ice-Breaking Capacity of the Vessel

Figure 17:
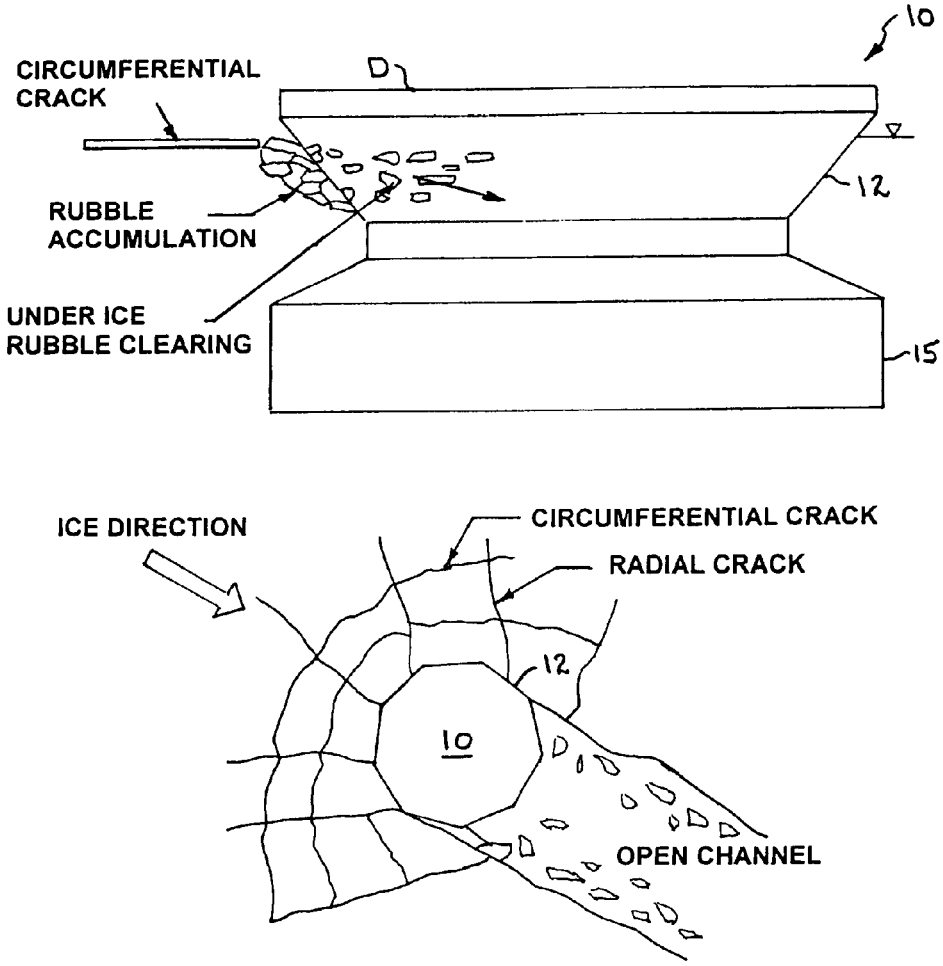
FIGS. 17 and 18 show schematic illustrations of the interaction of ice sheets, and ice ridges, respectively, with the vessel of FIG. 1.
Figure 18:
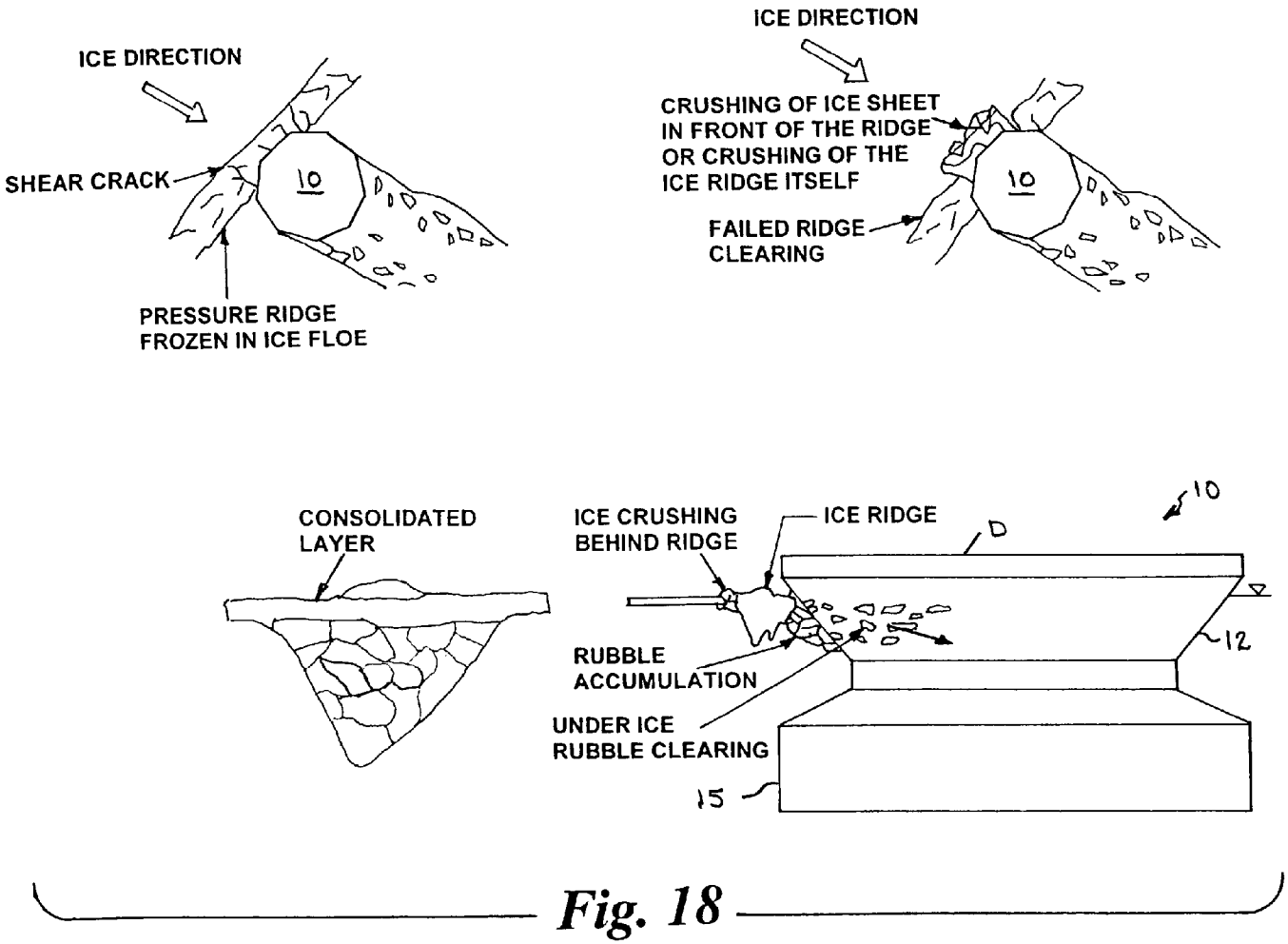
Figure 19:
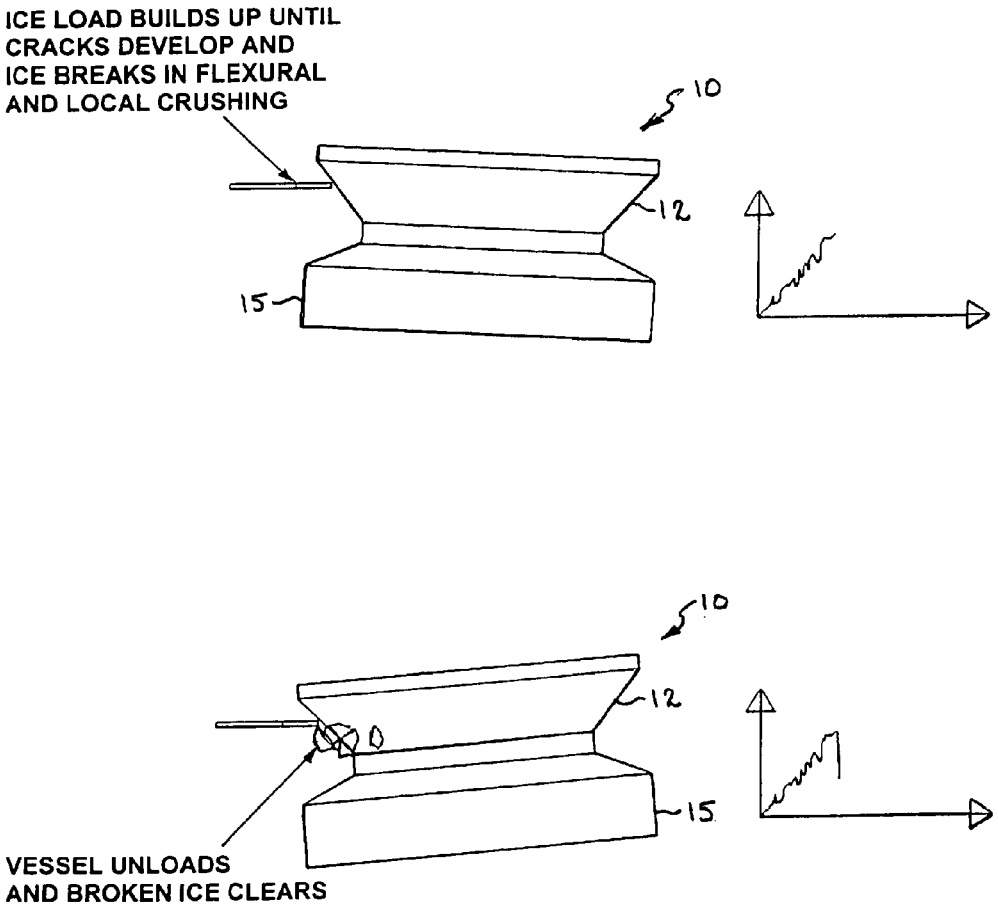
FIG. 19 is a schematic illustration the behavior of the vessel of FIG. 1 showing the vessel in a first and second position with the water ballast shifted to induce heave, roll, pitch and surge motion of the vessel and thereby dynamically break, bend and push ice sheets away.

Referring to FIGS. 17, 18 and 19, the vessel may be moored with a corner facing the predominant drift moving direction of ice floes. The uneven sided polygonal shape of the hull induces flexural failure of ice. Flexural failure is also induced by pitching motion of the vessel, which can be achieved by changing water levels in the ballast tanks. The broken pieces of ice ride down on the slope of the vessel, and finally clear around it. The ballast may be shifted to induce heave, roll, pitch and surge motions of the vessel and the angular side walls and corners of the hull exterior will resist and dynamically cut ice sheets, break ice floes, and maneuver ice pressure ridges away from the structure. The double tapered conical configuration of the moon pool significantly reduces dynamic amplification due to waves and facilitates maneuvering the vessel during heave, roll, pitch and surge motions.

The vessel is designed to be self-sufficient and survive peak winter storms in arctic environments. The hull is designed to decrease ice loads and provide more ice breaking mechanisms than conventional vessel structures. The more the ice breaks, the less environmental ice loads on the vessel. These goals are achieved by the increased large mass inertia of the vessel, increased size and lever arm of the ice-breaking sides from the center of the vessel, optimized slope of the ice-breaking sides of the vessel with respect to the ice sheets, and the induced continuous pitch and roll motion of the vessel.

The vessel achieves maximum inertia by providing maximum storage of water and oil and/or liquefied gas during operation. The vessel is designed to provide over one million barrels of oil and/or liquefied gas storage during operation. This increased volume and mass of the vessel is utilized for ice-breaking efficiency. The side walls are sloped to have, for example, a 45° upward/downward slope to break the ice efficiently. The sloped walls break ice sheet more efficiently than the vertical walls. The sloped ice breaking walls are double walled with honeycomb structure to provide more than adequate breaking capacity require to break ice-sheets of 1.5 m-4 m thick or more if required. They are also designed to break ice ridges up to about 25 m deep, and the sloped side walls reduce the ice pile-ups.

The sides are flat and have nine faces, thus, the ice loads are adequately resisted by each limited exposed face. The vessel pitch and roll motions are close to, or over, a 1 minute natural period. Since the vessel is bottom supported by the turret moorings, it is easy for the vessel to roll and pitch and break the ice-sheet over the sloped sides.

Most importantly, the vessel roll/pitch motions are induced externally by shifting the water ballast relative to the storage mass to provide continuous roll and pitch motion to break the ice. Thus the roll and pitch motions of the vessel can be excited to its resonant natural period. At resonant roll/pitch, the vessel is easily excited by the external forces and as required to overcome the damping due to the ice breaking and resistances. Such motions are accomplished by periodically pumping water mass from the ballast tanks on one side to the vessel to the other side, back and forth, for both roll and pitch. The motion induced by such external excitation breaks the ice all around the vessel near the free water surface. The bottom mounted turret pivots and aids in this continuous roll and pitch of the vessel.

Because the vessel lever arm is large from the center of the vessel to the sloping side walls where the ice sheets break, the amount of oscillatory tilt required at the center is less than a degree. An introduction of a small tilt at the center of the vessel introduces a large displacement, over a couple of feet, at the vessel side walls and thus breaks the ice sheets effortlessly, including thick ice-sheets. Ice sheets also break due to the slope of the side walls. The large vessel mass relative to the ice mass allows the vessel to break ice efficiently and effortlessly. The bottom part of the side walls are maintained well below 25 m to avoid keeling and grounding of ice-ridges on the vessel bottom side walls. In a preferred embodiment, the bottom sloped surfaces and keel are disposed quite a distance away from the free water surface to prevent damage to the exterior of the lower portion of the hull by a maximum 100 year return ice ridge.

Other Applications and Environments

Although the present vessel is designed to work in deepwater and in arctic ice-covered water during winter and clear water conditions during summer storm conditions, the vessel is also designed to support drilling/production/storage/off-loading operations in deepwater as a floating vessel. The vessel may also be employed in clear water deep-depth applications with no ice around.

The present vessel can also be used in a submerged condition in shallow water if needed in ice-covered water or in clear water and non-arctic environments. In that case the vessel is towed to the location and rested on the seabed and the ballast is controlled to provide stability and sea-bed resisting capacity. Since the vessel bottom is quite large, the vessel provides sufficient surface area for seabed bearing load.

Although the vessel has been described as having a polygonal configuration for ice-sheet breaking applications, it should be understood that the floating vessel may also be provided with a stepped cylindrical exterior configuration, rather than polygonal.

While this invention has been described fully and completely with special emphasis upon preferred embodiments, it should be understood that within the scope of the appended claims the invention may be practiced otherwise than as specifically described herein.

The invention claimed is:

1. An offshore floating production, storage and off-loading vessel structure for use in producing, storing and transporting oil and/or liquefied gas, comprising:

a hull having a top wall defining a deck, a bottom wall, and a generally cylindrical exterior side wall configuration surrounding a central moon pool, said side wall having a lower portion extending upwardly from said bottom wall and an upper portion extending angularly inward and upward therefrom terminating adjacent to a bottom of said deck;

ballast compartments and storage compartments contained in said hull;

an adjustable ballasting system for ballasting and debal-lasting selected said ballast compartments and storage compartments to induce heave, roll, pitch and surge motions of said vessel to dynamically position and maneuver said vessel and carry out moving operations;

said moon pool having a double tapered conical interior configuration with respect to a vertical axis for entrainment of water to selectively provide added hydrodynamic virtual mass to increase the natural period of the roll and heave modes, reduce dynamic amplification and resonance due to waves and vessel motion, and facilitate maneuvering the vessel; and said hull having a height from said bottom wall to said deck that is less than the largest diameter and less than the smallest diameter of said exterior side wall configuration.

2. The offshore floating structure according to claim 1, wherein said moon pool creates water flow and fills with water in the central core to reduce the effective water plane area sufficient to increase the heave natural period of said vessel without significantly reducing the overall moment of inertia of the remaining water plane area of said moon pool, and retain stability of said vessel.

3. The offshore floating structure according to claim 1, further comprising:

a central casing having a top end secured to said hull top wall in fluid tight relation and extending vertically downwardly therefrom through the center of said moon pool terminating in a bottom end adjacent to a lower end of said moon pool, said central casing defining an annulus between the casing exterior and said moon pool interior; and support means in a lower end of said moon pool adjoined to said central casing lower end for receiving and supporting an upper end of a buoyant turret buoy;

a buoyant turret buoy having an upper portion and a lower portion which rotate with respect to one another, said upper portion releasably engaged with said support means and said lower portion disposed beneath said hull bottom wall;

said turret buoy lower portion having at least one riser connection for connecting a first end of at least one flexible riser having a second end which extends from a seabed hydrocarbon supply location; and at least one second riser section extending vertically upward through said central casing from said turret buoy to said deck coupled at a lower end with said turret buoy in fluid communication with said first end of said flexible riser to form a fluid flow path from said seabed hydrocarbon supply to equipment on said deck.

4. The offshore floating structure according to claim 3, wherein said buoyant turret buoy upper portion is selectively disengaged from said support means when said vessel is subjected to harsh environments and winter or summer storms to allow relocation of said vessel and/or stationary mooring of said vessel with conventional mooring devices.

5. The offshore floating structure according to claim 3, wherein said support means in said lower end of said moon pool is configured to prevent water from flowing around said turret buoy upper portion and into the annulus between the exterior of said central casing and interior of said moon pool;

said hull has channels or tunnels extending angularly downward and outward from the interior of said moon pool to the exterior of said hull to allow water to enter into the annulus between the exterior of said central casing and interior of said moon pool; and mooring lines extending from winches on the deck, through the deck, and the interior of said moon pool and outwardly through said channels or tunnels supported by fairlead sheaves at each end of said channels or tunnels.

6. The offshore floating structure according to claim 3, further comprising:

a series of mooring lines connected between said turret buoy lower portion and the sea floor such that said floating structure can rotate and weathervane about said turret buoy in response to environmental forces of waves, wind, current, and heave, roll, pitch and surge motions.

7. The offshore floating structure according to claim 3, further comprising:

a series of mooring lines connected between said hull and the sea floor so as to provided resistance of said floating structure to pitch and roll motions in response to environmental forces of waves, wind, and current.

8. The offshore floating structure according to claim 1, further comprising:

a central casing having a top end secured to said hull top wall in fluid tight relation and extending vertically downwardly therefrom through the center of said moon pool terminating in a bottom end adjacent to a lower end of said moon pool, said central casing defining an annulus between the casing exterior and said moon pool interior; and support means in a lower end of said moon pool adjoined to said central casing lower end having openings therethrough to allow water entry into said annulus around said casing exterior.

9. The offshore floating structure according to claim 1, further comprising:

virtual mass trap and fluid damping means associated with a lower portion of said hull for entrapping water to provide additional hydrodynamic virtual mass to minimize heave response, increase the natural period of roll and heave modes, reduce dynamic amplification and resonance due to waves and vessel motion, and facilitate maneuvering the vessel.

10. The offshore floating structure according to claim 7, wherein said virtual mass trap and fluid damping means comprises one or more plate-like members extending horizontally outward from a lower portion of said exterior side wall of said hull.

11. The offshore floating structure according to claim 7, wherein said virtual mass trap and fluid damping means comprises one or more upper plate-like members extending horizontally outward from a lower portion of said exterior side wall of said hull; and one or more horizontal outwardly extending lower plate-like members disposed a distance below said one or more upper plate-like members and below said hull bottom wall to provide a space for entrapping water therebetween to provide additional hydrodynamic virtual mass and fluid damping to minimize heave, roll and pitch response, increase the natural period of roll, pitch and heave modes, reduce dynamic amplification and resonance due to waves and vessel motion, and facilitate stabilizing and maneuvering the vessel.

12. The offshore floating structure according to claim 1, wherein said moon pool is a double tapered conical configuration having a lower portion of a first transverse dimension extending vertically upward from said hull bottom wall to a first elevation, an intermediate portion diverging angularly upward and outward therefrom to a second greater transverse dimension at a second elevation, and an upper vertical portion of said greater transverse dimension continuing vertically upward therefrom to a third elevation; and said first transverse dimension of said lower portion is of a size and height sufficient to provide larger said ballast compartments and storage compartments at a lower portion of said hull, provide a reduced water plane area in said moon pool at an elevation near to the still water level, and to lower the overall center of gravity of said vessel to the lower portion of said hull and thereby increase stability of said vessel.

13. The offshore floating structure according to claim 10, wherein the center of gravity of said hull is raised or lowered relative to the center of buoyancy of said hull depending upon the weight of said ballast compartments and the weight of said storage compartments, and stability of the vessel is achieved when the center of gravity is either above or below the center of buoyancy.

14. The offshore floating structure according to claim 10, further comprising:

damping means on the interior of said moon pool for reducing resonance of water in said moon pool due to waves and vessel motion.

15. The offshore floating structure according to claim 12, wherein said damping means on the interior of said moon pool comprises a plurality of inwardly facing vertically spaced baffle plates on the interior of said moon pool.

16. The offshore floating structure according to claim 1, further comprising:

a telescoping vertically adjustable ballast keel tank adjoined to said hull structure so as to be movable between a retracted position closely adjacent to said bottom wall of said hull and an extended position disposed a distance therebelow; and in said extended position, water is entrapped in the space between said hull bottom wall and said keel tank to provide additional hydrodynamic virtual mass to minimize heave response, increase the natural period of roll and heave modes, reduce dynamic amplification and resonance due to waves and vessel motion, and facilitate maneuvering the vessel.

17. The offshore floating structure according to claim 1, further comprising:

a telescoping vertically adjustable ballast keel tank adjoined to said hull structure so as to be movable between a retracted position closely adjacent to said bottom wall of said hull and an extended position disposed a distance therebelow; and in said extended position, the mass of the ballast in said keel tank and the distance between said hull bottom wall and said keel tank is optionally adjusted to position the center of gravity of said hull below the center of buoyancy to achieve stability of the vessel.

* * * * *